US008602209B2

(12) United States Patent
Jones et al.

(10) Patent No.: US 8,602,209 B2
(45) Date of Patent: Dec. 10, 2013

(54) PACKAGE FOR CONTAINERS

(75) Inventors: Edward W. Jones, Hiram, GA (US); Ana Gonzalez, Igualada (ES); Emili Requena, Igualada (ES); Jean-Manuel Gomes, Marietta, GA (US); Kevin T. May, Kennesaw, GA (US); Colin Ford, Woodstock, GA (US); Matthew Sundquist, Brainerd, MN (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 13/111,029

(22) Filed: May 19, 2011

(65) Prior Publication Data

US 2011/0284623 A1 Nov. 24, 2011

Related U.S. Application Data

(60) Provisional application No. 61/395,885, filed on May 19, 2010.

(51) Int. Cl.
*B65D 1/22* (2006.01)

(52) U.S. Cl.
USPC ..... 206/148; 206/147; 206/149; 206/427; 206/429

(58) Field of Classification Search
USPC ..... 206/148, 145, 147, 153, 157–158, 427, 206/429, 431, 434–435, 430, 432, 428, 499, 206/152, 155, 156, 526; 229/103.2, 244, 229/117.13, 40, 139, 140, 148–149, 160, 229/198.2; 53/458; 220/62; 493/84; 426/108, 119
See application file for complete search history.

(56) References Cited

U.S. PATENT DOCUMENTS 1,527,399 A 2/1925 Davidson
1,925,102 A 9/1933 Levkoff (Continued)

FOREIGN PATENT DOCUMENTS

CA 873185 A1 6/1971
DE 202 13 450 U1 11/2002

(Continued)

OTHER PUBLICATIONS

International Search Report and Written Opinion mailed Dec. 18, 2008 for PCT/US2008/080279, Graphic Packaging International, Inc. (applicant).

(Continued)

*Primary Examiner* — Andrew Perreault
*Assistant Examiner* — James M Van Buskirk
(74) *Attorney, Agent, or Firm* — Womble Carlyle Sandridge & Rice, LLP

(57) ABSTRACT

A carrier that is at least partially holding a plurality of containers. The carrier can include a plurality of panels comprising a bottom panel, a first side panel foldably connected to the bottom panel, a second side panel foldably connected to the bottom panel, a first top panel foldably connected to the first side panel, and a second top panel foldably connected to the second side panel. At least one container-receiving feature extends in at least the bottom panel. The at least one container-receiving feature can at least partially receive at least one container of the plurality of containers. At least one retention flap is foldably connected to the first top panel or the second top panel. The at least one retention flap engages at least a portion of a flange of at least one container.

66 Claims, 29 Drawing Sheets

(56) References Cited

U.S. PATENT DOCUMENTS 2,005,924 A 6/1935 Wilson
2,067,749 A 1/1937 Zimmerman et al.
2,115,673 A 4/1938 Stompe
2,289,859 A 7/1942 Arthur
2,299,027 A 10/1942 Novak
2,522,950 A 9/1950 Keith
2,669,351 A 2/1954 Carson et al.
2,754,047 A 7/1956 Schmidt et al.
2,798,603 A 7/1957 Grinspoon
2,950,041 A 8/1960 Stone
3,078,032 A 2/1963 Robinson et al.
3,128,010 A 4/1964 Forrer
3,133,634 A 5/1964 Bozdar
3,137,109 A 6/1964 Rapata
3,156,358 A * 11/1964 Randrup ..... 206/153
3,178,242 A 4/1965 Ellis et al.
3,228,582 A 1/1966 Osberg
3,245,711 A * 4/1966 Dantoin ..... 294/87.2
3,263,861 A 8/1966 Carr
3,265,283 A 8/1966 Farquhar
3,300,115 A 1/1967 Schauer
3,332,594 A 7/1967 De Capua
3,346,167 A 10/1967 Schmidt
3,356,279 A 12/1967 Root
3,517,858 A 6/1970 Farquhar
3,528,697 A 9/1970 Wood
3,533,549 A 10/1970 Gilchrist
3,540,581 A 11/1970 Koolnis
3,601,439 A 8/1971 Poupitch
3,627,121 A 12/1971 Deasy
3,640,563 A * 2/1972 Wood ..... 294/87.2
3,698,550 A * 10/1972 Graser ..... 206/140
3,722,945 A * 3/1973 Wood ..... 294/87.2
3,752,305 A * 8/1973 Heyne ..... 206/147
3,860,287 A * 1/1975 Platt ..... 297/452.52
3,897,873 A 8/1975 Graser
3,942,631 A 3/1976 Sutherland et al.
4,029,204 A 6/1977 Manizza
4,155,449 A 5/1979 Bryne
4,192,540 A 3/1980 Oliff
4,214,660 A 7/1980 Hunt, Jr.
4,216,861 A * 8/1980 Oliff ..... 206/427
4,222,485 A 9/1980 Focke
4,256,226 A 3/1981 Stone
4,304,329 A 12/1981 Graser
4,305,500 A * 12/1981 Jaeschke ..... 206/153
4,318,474 A 3/1982 Hasegawa
4,364,509 A 12/1982 Holley, Jr. et al.
4,372,599 A 2/1983 Kiedaisch et al.
4,375,258 A 3/1983 Crayne et al.
4,376,509 A 3/1983 Schaffer
4,378,877 A 4/1983 Botterman et al.
4,378,879 A 4/1983 Killy
4,382,505 A 5/1983 Sutherland et al.
4,396,143 A 8/1983 Killy
4,398,636 A * 8/1983 Baxter ..... 229/242
4,417,655 A 11/1983 Forbes, Jr.
4,417,661 A * 11/1983 Roccaforte ..... 229/232
4,566,591 A * 1/1986 Turtschan et al. ..... 206/427
4,577,762 A 3/1986 Kuchenbecker
4,605,128 A 8/1986 Rieke
4,658,984 A 4/1987 Brunner
4,784,266 A 11/1988 Chaussadas
4,817,866 A 4/1989 Wonnacott
4,890,440 A 1/1990 Romagnoli
4,949,845 A 8/1990 Dixon
4,974,771 A 12/1990 Lavery
5,101,642 A 4/1992 Alexandrov
5,137,211 A 8/1992 Summer et al.
5,139,147 A 8/1992 Sutherland
5,188,225 A 2/1993 Jorba
5,201,412 A * 4/1993 Schuster et al. ..... 206/153
5,219,229 A 6/1993 Sengewald
5,234,103 A * 8/1993 Schuster ..... 206/158
5,246,113 A 9/1993 Schuster
5,249,681 A 10/1993 Miller
5,267,644 A 12/1993 Tsao
5,297,673 A 3/1994 Sutherland
5,310,050 A 5/1994 Sutherland
5,310,051 A 5/1994 Sutherland
5,318,178 A 6/1994 Davies et al.
5,323,895 A 6/1994 Sutherland et al.
5,328,024 A 7/1994 Sutherland
5,351,815 A 10/1994 Fogle et al.
5,351,816 A 10/1994 Sutherland et al.
5,351,817 A 10/1994 Sutherland
5,355,999 A * 10/1994 Sutherland ..... 206/153
5,360,104 A 11/1994 Sutherland
5,390,784 A 2/1995 Sutherland
5,407,065 A 4/1995 Sutherland
5,415,278 A 5/1995 Sutherland
5,425,474 A 6/1995 Dalea et al.
5,443,153 A 8/1995 Sutherland
5,445,262 A 8/1995 Sutherland
5,452,799 A 9/1995 Sutherland
5,476,170 A * 12/1995 Weber ..... 206/147
5,482,185 A 1/1996 McNaughton
5,503,267 A 4/1996 Sutherland
5,505,372 A 4/1996 Edson et al.
5,520,283 A 5/1996 Sutherland
5,524,756 A 6/1996 Sutherland
5,551,566 A 9/1996 Sutherland
5,553,705 A 9/1996 Bakx
5,577,612 A 11/1996 Chesson et al.
5,593,027 A 1/1997 Sutherland
5,597,114 A 1/1997 Kramedjian et al.
5,622,309 A 4/1997 Matsuda et al.
5,664,683 A 9/1997 Brody
5,667,070 A 9/1997 Miret
5,690,213 A 11/1997 Matsumura
5,690,230 A 11/1997 Griffith
5,706,936 A 1/1998 Bernstein
5,711,419 A 1/1998 Beales et al.
5,746,310 A 5/1998 Slomski
5,791,463 A 8/1998 Negelen
5,794,778 A 8/1998 Harris
5,816,391 A 10/1998 Harris
5,820,185 A 10/1998 Gomes
5,826,783 A 10/1998 Stout
5,875,961 A 3/1999 Stone et al.
5,881,884 A 3/1999 Podosek
5,921,398 A 7/1999 Carroll
5,924,559 A 7/1999 Carrel et al.
5,927,498 A 7/1999 Saam
5,960,945 A 10/1999 Sutherland
6,039,181 A 3/2000 Whiteside
6,050,402 A 4/2000 Walter
6,059,099 A 5/2000 Galbierz
6,176,419 B1 1/2001 Holley, Jr.
6,223,892 B1 * 5/2001 Bakx ..... 206/148
6,241,083 B1 * 6/2001 Harrelson ..... 206/141
6,283,293 B1 9/2001 Lingamfelter
6,315,111 B1 11/2001 Sutherland
6,394,272 B1 5/2002 Domansky
6,409,077 B1 6/2002 Telesca et al.
D459,927 S 7/2002 Flowers et al.
6,478,219 B1 11/2002 Holley, Jr.
6,484,903 B2 11/2002 Spivey et al.
6,488,322 B2 * 12/2002 Bakx ..... 294/87.2
6,550,615 B2 4/2003 Lingamfelter
6,557,699 B1 5/2003 Focke et al.
6,578,736 B2 6/2003 Spivey
6,604,677 B1 8/2003 Sutherland et al.
6,669,083 B2 12/2003 Bates
6,715,639 B2 4/2004 Spivey
6,752,262 B1 6/2004 Boriani et al.
6,789,673 B2 9/2004 Lingamfelter
6,866,186 B2 3/2005 Fogle et al.
6,866,188 B2 3/2005 Harrelson
6,896,130 B2 5/2005 Theelen
6,902,104 B2 6/2005 Holley, Jr. et al.
6,918,487 B2 7/2005 Harrelson
6,929,172 B2 8/2005 Bates et al.
6,945,450 B2 9/2005 Rusnock

(56) References Cited

U.S. PATENT DOCUMENTS

| | | | | |
|---|---|---|---|---|
| 6,968,992 | B2 | 11/2005 | Schuster | |
| 6,969,172 | B2 | 11/2005 | Actis-Datta | |
| 6,974,072 | B2 | 12/2005 | Harrelson | |
| 6,991,107 | B2 | 1/2006 | Harrelson | |
| 6,997,316 | B2 | 2/2006 | Sutherland | |
| 7,000,803 | B2 | 2/2006 | Miller | |
| 7,011,209 | B2 | 3/2006 | Sutherland et al. | |
| 7,104,435 | B2 | 9/2006 | Holley, Jr. | |
| 7,134,593 | B2 | 11/2006 | Harrelson | |
| 7,168,558 | B2 | 1/2007 | Harrelson | |
| 7,225,930 | B2 | 6/2007 | Ford et al. | |
| 7,240,789 | B2 | 7/2007 | Sutherland | |
| 7,264,114 | B2 * | 9/2007 | Daniel | 206/152 |
| 7,374,038 | B2 * | 5/2008 | Smalley | 206/175 |
| 7,690,507 | B2 | 4/2010 | Sutherland | |
| 7,721,878 | B2 | 5/2010 | Requena | |
| 7,789,231 | B2 | 9/2010 | Requena | |
| 7,823,721 | B2 | 11/2010 | Sutherland | |
| 2002/0029991 | A1 | 3/2002 | Lingamfelter | |
| 2002/0070139 | A1 | 6/2002 | Bates | |
| 2002/0088820 | A1 | 7/2002 | Spivey | |
| 2002/0088821 | A1 | 7/2002 | Spivey et al. | |
| 2002/0185499 | A1 | 12/2002 | Harrelson et al. | |
| 2002/0195371 | A1 | 12/2002 | Brown | |
| 2003/0080004 | A1 | 5/2003 | Olsen et al. | |
| 2003/0141313 | A1 | 7/2003 | Bates | |
| 2003/0150759 | A1 | 8/2003 | White, Jr. | |
| 2003/0192907 | A1 | 10/2003 | Bates | |
| 2003/0213705 | A1 | 11/2003 | Woog | |
| 2004/0011674 | A1 | 1/2004 | Theelen | |
| 2004/0060972 | A1 | 4/2004 | Harrelson | |
| 2004/0089575 | A1 | 5/2004 | Lingamfelter | |
| 2004/0089671 | A1 | 5/2004 | Miller | |
| 2004/0099558 | A1 | 5/2004 | Oliff et al. | |
| 2004/0155098 | A1 | 8/2004 | Harrelson | |
| 2004/0188277 | A1 | 9/2004 | Auclair | |
| 2004/0188300 | A1 | 9/2004 | Sutherland | |
| 2004/0226833 | A1 | 11/2004 | Daniel | |
| 2005/0023170 | A1 | 2/2005 | Lingamfelter | |
| 2005/0092820 | A1 | 5/2005 | Chekroune | |
| 2005/0103650 | A1 | 5/2005 | Auclair et al. | |
| 2005/0126947 | A1 | 6/2005 | Holley, Jr. | |
| 2005/0127151 | A1 | 6/2005 | Johnson | |
| 2005/0178791 | A1 | 8/2005 | Miller | |
| 2005/0189405 | A1 | 9/2005 | Gomes et al. | |
| 2005/0224565 | A1 | 10/2005 | Holley | |
| 2006/0054522 | A1 | 3/2006 | Kline et al. | |
| 2006/0091193 | A1 | 5/2006 | DeBusk | |
| 2006/0118606 | A1 | 6/2006 | Holley, Jr. et al. | |
| 2006/0131370 | A1 | 6/2006 | Bates | |
| 2006/0175386 | A1 | 8/2006 | Holley, Jr. | |
| 2008/0121536 | A1 | 5/2008 | Miret | |
| 2008/0135423 | A1 | 6/2008 | Oliveira | |
| 2009/0101526 | A1 | 4/2009 | Sutherland et al. | |
| 2009/0127147 | A1 | 5/2009 | Sutherland | |
| 2009/0266872 | A1 * | 10/2009 | Fogle et al. | 229/100 |
| 2010/0264043 | A1 | 10/2010 | De Paula | |
| 2011/0000799 | A1 | 1/2011 | Gonzalez | |

FOREIGN PATENT DOCUMENTS

| | | | |
|---|---|---|---|
| EP | 0 066 029 | A1 | 12/1992 |
| FR | 2 549 010 | | 1/1985 |
| GB | 2 264 101 | A | 8/1993 |
| JP | 2003-146359 | | 5/2003 |
| WO | WO 96-29260 | | 9/1996 |
| WO | WO 9849071 | A1 * | 11/1998 |
| WO | WO 99-064301 | | 12/1999 |
| WO | WO 00-03937 | | 1/2000 |
| WO | WO 02-47990 | A2 | 6/2002 |
| WO | WO 2004-043790 | A2 | 5/2004 |
| WO | WO 2005-051781 | A1 | 6/2005 |
| WO | WO 2006-050210 | A2 | 5/2006 |
| WO | WO 2006-050316 | A1 | 5/2006 |

OTHER PUBLICATIONS

International Search Report and Written Opinion mailed Feb. 5, 2010 for PCT/US2009/061594, Graphic Packaging International, Inc. (applicant).

European Office Action for related application No. 07 752 956.8-2308, mailed Jul. 7, 2010.

International Search Report and Written Opinion mailed Sep. 2, 2010 for PCT/US2010/025178.

International Search Report and Written Opinion dated Mar. 1, 2011 for PCT/US2010/041661.

International Search Report and Written Opinion dated Aug. 12, 2011 for PCT/US2011/037090.

* cited by examiner

PACKAGE FOR CONTAINERS

CROSS-REFERENCE TO RELATED APPLICATIONS

This application claims the benefit of U.S. Provisional Patent Application No. 61/395,885, filed May 19, 2010.

INCORPORATION BY REFERENCE

U.S. Provisional Patent Application No. 61/395,885, which was filed on May 19, 2010, is hereby incorporated by reference for all purposes as if presented herein in its entirety.

BACKGROUND OF THE DISCLOSURE

The present disclosure generally relates to packages or carrier cartons for holding and displaying containers. More specifically, the disclosure is directed to a carrier having features that at least partially restrain movement of the containers held in the package.

SUMMARY OF THE DISCLOSURE

In general, one aspect of the disclosure is directed to a carrier that is at least partially holding a plurality of containers. Each container comprises a flange. The carrier comprises a plurality of panels extending at least partially around an interior of the carrier. The panels comprise a bottom panel, a first side panel foldably connected to the bottom panel, a second side panel foldably connected to the bottom panel, a first top panel foldably connected to the first side panel, and a second top panel foldably connected to the second side panel. At least one container-receiving feature extends in at least the bottom panel. The at least one container-receiving feature can at least partially receive at least one container of the plurality of containers. A first retention flap is foldably connected to the first top panel and a second retention flap is foldably connected to the second top panel. At least one of the first retention flap and the second retention flap engages at least a portion of the flange of at least one container of the plurality of containers.

In another aspect, the disclosure is generally directed to a carrier that is at least partially holding a plurality of containers. Each container comprises a flange. The carrier comprises a plurality of panels extending at least partially around an interior of the carrier. The panels comprise a bottom panel, a first side panel foldably connected to the bottom panel, a second side panel foldably connected to the bottom panel, a first top panel foldably connected to the first side panel, and a second top panel foldably connected to the second side panel. At least one container-receiving feature can extend in at least the bottom panel. The at least one container-receiving feature can at least partially receive at least two containers of the plurality of containers. The at least one container-receiving feature comprises at least a first brace flap and a second brace flap. Each of the first brace flap and the second brace flap can extend in a generally longitudinal direction.

In another aspect, the disclosure is generally directed to a blank for forming a carrier for at least partially holding a plurality of containers. Each container comprises a flange. The blank comprises a plurality of panels comprising a bottom panel, a first side panel foldably connected to the bottom panel, a second side panel foldably connected to the bottom panel, a first top panel foldably connected to the first side panel, and a second top panel foldably connected to the second side panel. At least one container-receiving feature extends in at least the bottom panel for at least partially receiving at least one container of the plurality of containers when the carrier is formed from the blank. A first retention flap is foldably connected to the first top panel and a second retention flap is foldably connected to the second top panel. At least one of the first retention flap and the second retention flap is for engaging at least a portion of the flange of at least one container of the plurality of containers when the carrier is formed from the blank.

In another aspect, the disclosure is generally directed to a blank for forming a carrier for at least partially holding a plurality of containers. Each container comprises a flange. The blank comprises a plurality of panels comprising a bottom panel, a first side panel foldably connected to the bottom panel, and a second side panel foldably connected to the bottom panel, a first top panel foldably connected to the first side panel, and a second top panel foldably connected to the second side panel. At least one container-receiving feature extends in at least the bottom panel. The at least one container-receiving feature is for at least partially receiving at least two containers of the plurality of containers when the carrier is formed from the blank. The at least one container-receiving feature comprises at least a first brace flap and a second brace flap. Each of the first brace flap and the second brace flap extends in a generally longitudinal direction.

In another aspect, the disclosure is generally directed to a method of forming a carrier at least partially holding a plurality of containers. Each container comprises a flange. The method comprises obtaining a blank comprising a plurality of panels comprising a bottom panel, a first side panel foldably connected to the bottom panel, a second side panel foldably connected to the bottom panel, a first top panel foldably connected to the first side panel, a second top panel foldably connected to the second side panel, a first retention flap foldably connected to the first top panel, and a second retention flap foldably connected to the second top panel. At least one container-receiving feature extends in at least the bottom panel. The method further comprises inserting at least a portion of at least one container of the plurality of containers through the at least one container-receiving feature and forming an interior of the carrier at least partially defined by the plurality of panels. The flanges of each container of the plurality of containers is at least partially enclosed in the interior of the carrier. The method further comprises positioning at least one of the first retention flap and the second retention flap to engage at least a portion of the flange of at least one container of the plurality of containers.

In another aspect, the disclosure is generally directed to a method of forming a carrier at least partially holding a plurality of containers. Each container comprises a flange. The method comprises obtaining a blank comprising a plurality of panels comprising a bottom panel, a first side panel foldably connected to the bottom panel, and a second side panel foldably connected to the bottom panel, a first top panel foldably connected to the first side panel, and a second top panel foldably connected to the second side panel. At least one container-receiving feature extends in at least the bottom panel and comprises at least a first brace flap and a second brace flap. Each of the first brace flap and the second brace flap extends in a generally longitudinal direction. The method further comprises inserting at least a portion of a first container of the plurality of containers and at least a portion of a second container of the plurality of containers through the at least one container-receiving feature, and forming an interior of the carrier at least partially defined by the plurality of panels. The flanges of each container of the plurality of containers is at least partially enclosed in the interior of the carrier.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to constructs, sleeves, cartons, or the like, and packages for holding and displaying articles such as containers, jars, bottles, cans, etc. The articles can be used for packaging food and beverage products, for example. The articles can be made from materials suitable in composition for packaging the particular food or beverage item, and the materials include, but are not limited to, plastics such as PET, LDPE, LLDPE, HDPE, PP, PS, PVC, EVOH, and Nylon; and the like; aluminum and/or other metals; glass; or any combination thereof.

Carriers according to the present disclosure can accommodate articles of numerous different shapes. For the purpose of illustration and not for the purpose of limiting the scope of the disclosure, the following detailed description describes food or beverage product containers (e.g., plastic containers) at least partially disposed within the carrier embodiments. In this specification, the terms "lower," "bottom," "upper" and "top" indicate orientations determined in relation to fully erected packages.

A carrier 1 of a first embodiment is illustrated in its erected state in FIGS. 5-10, in which it is attached to containers C to form a package 2. In the illustrated embodiments the containers C are illustrated as single-serving beverage containers having a top flange portion F, but other containers may be held in the carrier 1 without departing from the disclosure. Further, six containers C are arranged in a 3×2 configuration in the first embodiment, but other quantities of containers can be held in the carrier, or the containers could be alternatively arranged.

Figure 1:
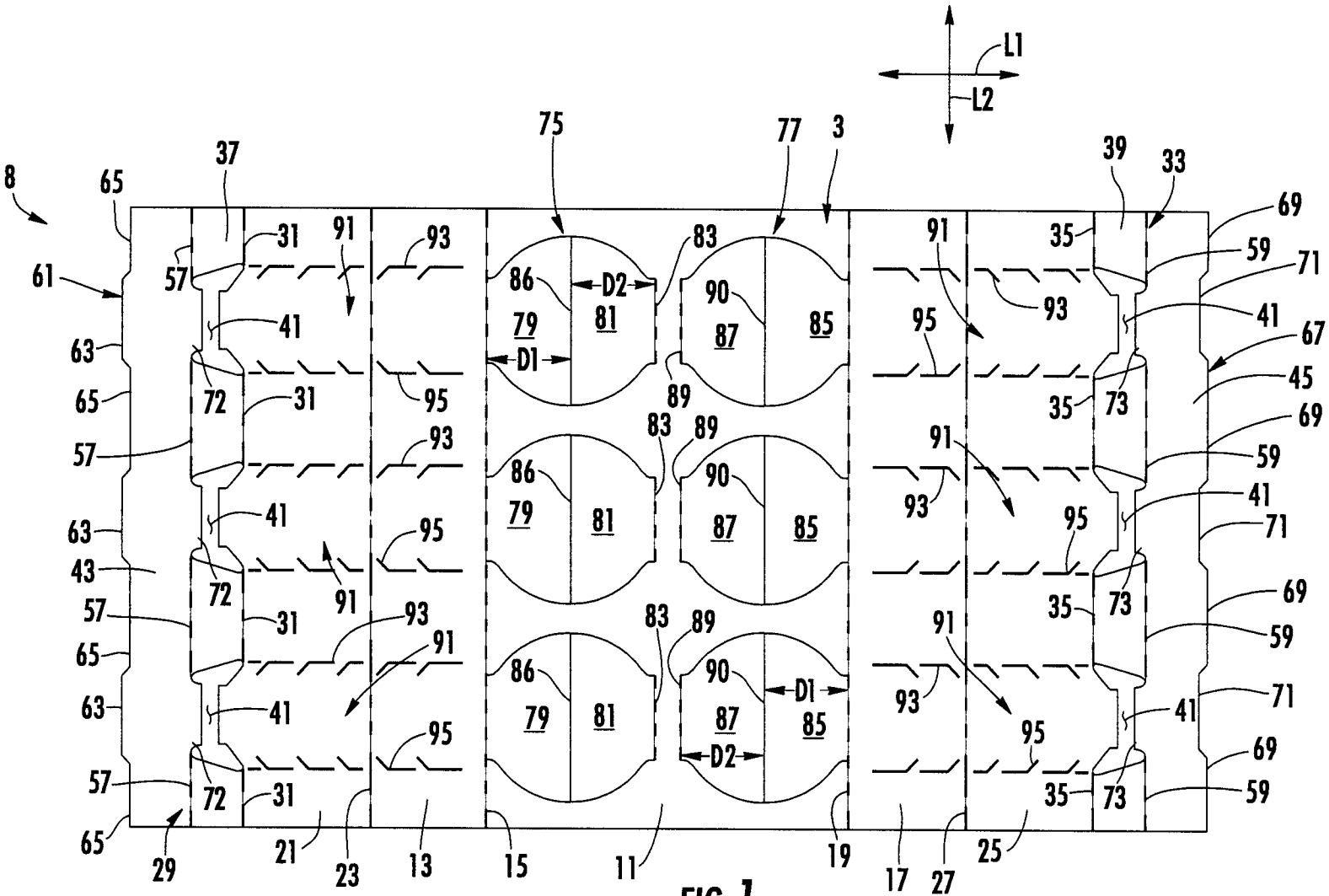
FIG. 1 is an exterior plan view of a blank for forming a package according to a first embodiment of the disclosure.

FIG. 1 is a plan view of an exterior side 3 of a blank 8 used to form the carrier 1 according to the first embodiment of the disclosure. The blank 8 has a longitudinal axis L1 and a lateral axis L2. The blank 8 comprises a bottom panel 11 foldably connected to a first side panel 13 at a first lateral fold line 15. A second side panel 17 is foldably connected to the bottom panel 11 at a second lateral fold line 19. A first top panel 21 is foldably connected to the first side panel 13 at a lateral fold line 23. A second top panel 25 is foldably connected to the second side panel 17 at a lateral fold line 27. A first retention flap 29 is foldably connected to the first top panel 21 at a series of spaced-apart lateral fold lines 31. A second retention flap 33 is foldably connected to the second top panel 25 at a series of spaced-apart lateral fold lines 35.

Each of the first retention flap 29 and the second retention flap 33 comprises a respective proximal or first portion 37, 39 adjacent a respective one of the first top panel 21 and the second top panel 23. Each of the first portions 37, 39 have respective openings 41 that are shaped to at least partially receive a flange F of the containers when the blank 8 is formed into the carrier 1. Each of the retention flaps 29, 33 have a respective distal or second (retention) portion 43, 45 that is foldably connected to a respective first portion 37, 39 at a respective spaced-apart lateral fold lines 57, 59. The edge 61 of the retention portion 43 of the first retention flap 29 has adjacent protrusions 63 and recesses 65. The edge 67 of the retention portion 45 of the second retention flap 33 has adjacent protrusions 69 and recesses 71. In one embodiment, the protrusions 63 of the first edge 61 are laterally aligned with the recesses 71 of the second edge 67. The recesses 65 of the first edge 61 are laterally aligned with the protrusions 69 of the second edge. The retention portion 43 of the first retention flap 29 can include a tab 72 adjacent each of the openings 41 in the first portion 37 of the first retention flap 29, and the retention portion 45 of the second retention flap 33 can include a tab 73 adjacent each of the openings 41 in the first portion 39 of the second retention flap 33. The blank 8 could be otherwise shaped, arranged, and/or configured without departing from the scope of the disclosure.

One or more cuts may be included in each of the transverse fold lines 15, 19, 23, 27, 31, 33, 57, 59. In the embodiment illustrated in FIG. 1, the transverse fold lines 15, 19, 23, 27, 31, 33, 57, 59 are cut/crease lines in which the cuts facilitate folding of the blank 8 at the fold lines. Any number of cuts may be formed in any of the fold lines, and the number and length of the cuts may be selected according to, for example, the gauge and/or the stiffness of the material used to form the blank 8. The fold lines 15, 19, 23, 27, 31, 33, 57, 59 may be formed by other methods (e.g., crease lines without cuts) without departing from the disclosure.

The bottom panel 11 includes a plurality of first and second container-receiving patterns 75, 77, respectively. Each container-receiving pattern 75, 77 is shaped and sized to receive an upper flange portion F of a container C (FIG. 2) that is to be at least partially accommodated within the carrier 1. In the embodiment of FIG. 1, each first container-receiving pattern 75 defines a first brace flap 79 foldably attached to the first side panel 13 at the lateral fold line 15 and a second brace flap 81 foldably connected to the bottom panel 11 at a respective lateral fold line 83. The first and second brace flaps 79, 81 of each first container-receiving pattern 75 can be separable along a first cut line 86. Each second container-receiving pattern 77 defines a first brace flap 85 foldably attached to the second side panel 17 at the lateral fold line 19 and a second brace flap 87 foldably connected to the bottom panel 11 at a respective lateral fold line 89. The first and second brace flaps 85, 87 of each second container-receiving pattern 77 can be separable along a second cut line 90. In one embodiment, each of the cut lines 86, 90 can be spaced apart from the respective lateral fold lines 15, 19 a first distance D1 and can be spaced apart from the respective lateral fold lines 83, 89 a second distance D2. The distance D1 can be greater than the distance D2. Alternatively, the distances D1, D2 could be equal, or distance D2 could be greater than distance D1. The first and second container-receiving patterns 75, 77 could be otherwise shaped, arranged, configured, and/or omitted without departing from the disclosure.

In the embodiment of FIG. 1, the blank 8 includes opening features 91 adjacent to each of the openings 41. The opening features 91 comprise two spaced-apart tear lines 93, 95 that extend in the longitudinal direction L1 from a respective opening 41, to form a tear strip extending across a respective one of the first and second top panels 21, 25 and into a respective one of the first and second side panels 13, 17. The opening features 91 could be otherwise shaped, arranged, configured, and/or omitted without departing from the scope of the disclosure.

Figure 2:
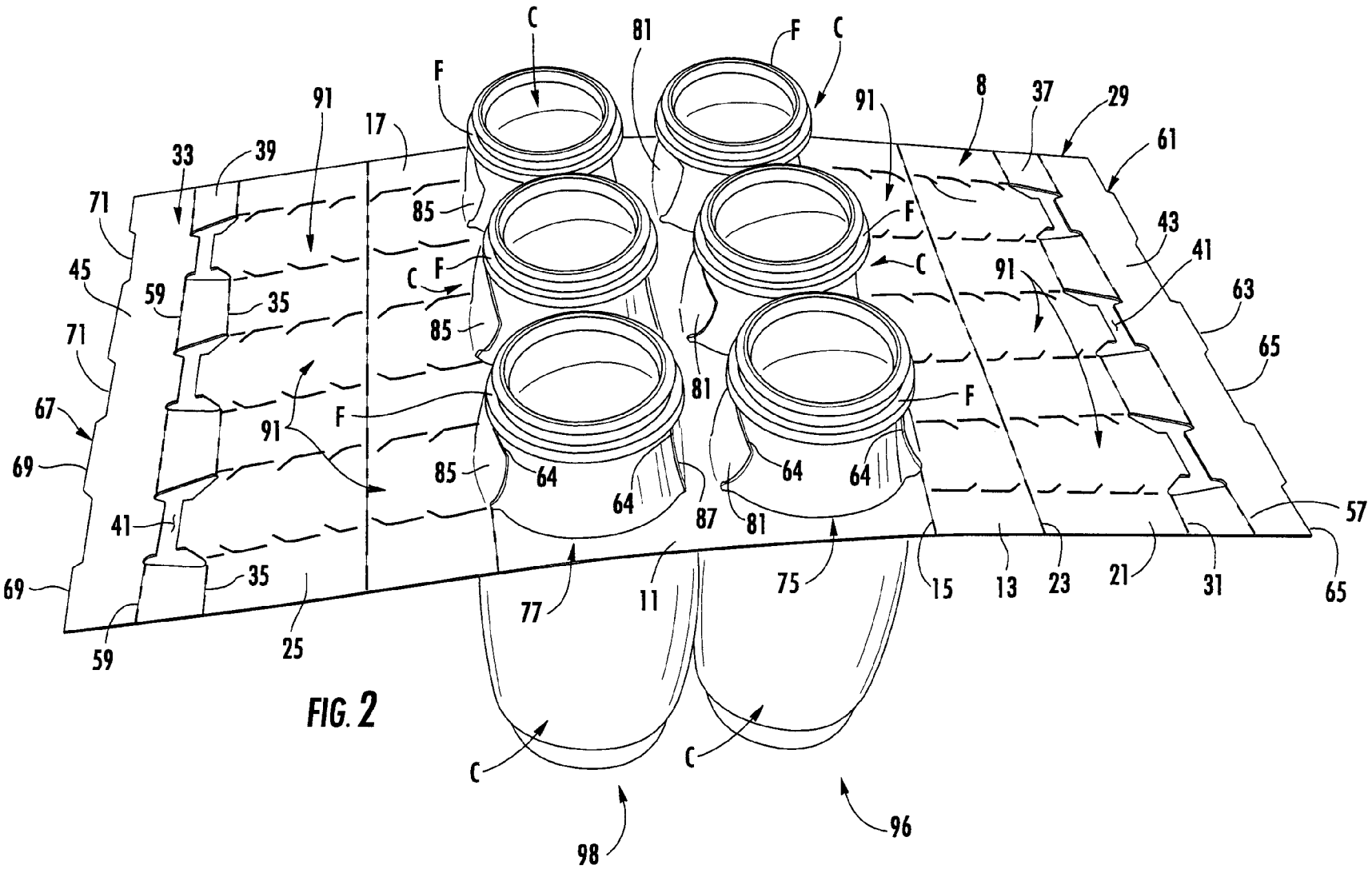
FIGS. 2-4 are perspective views showing the erection of the package according to the first embodiment of the disclosure.
Figure 3:
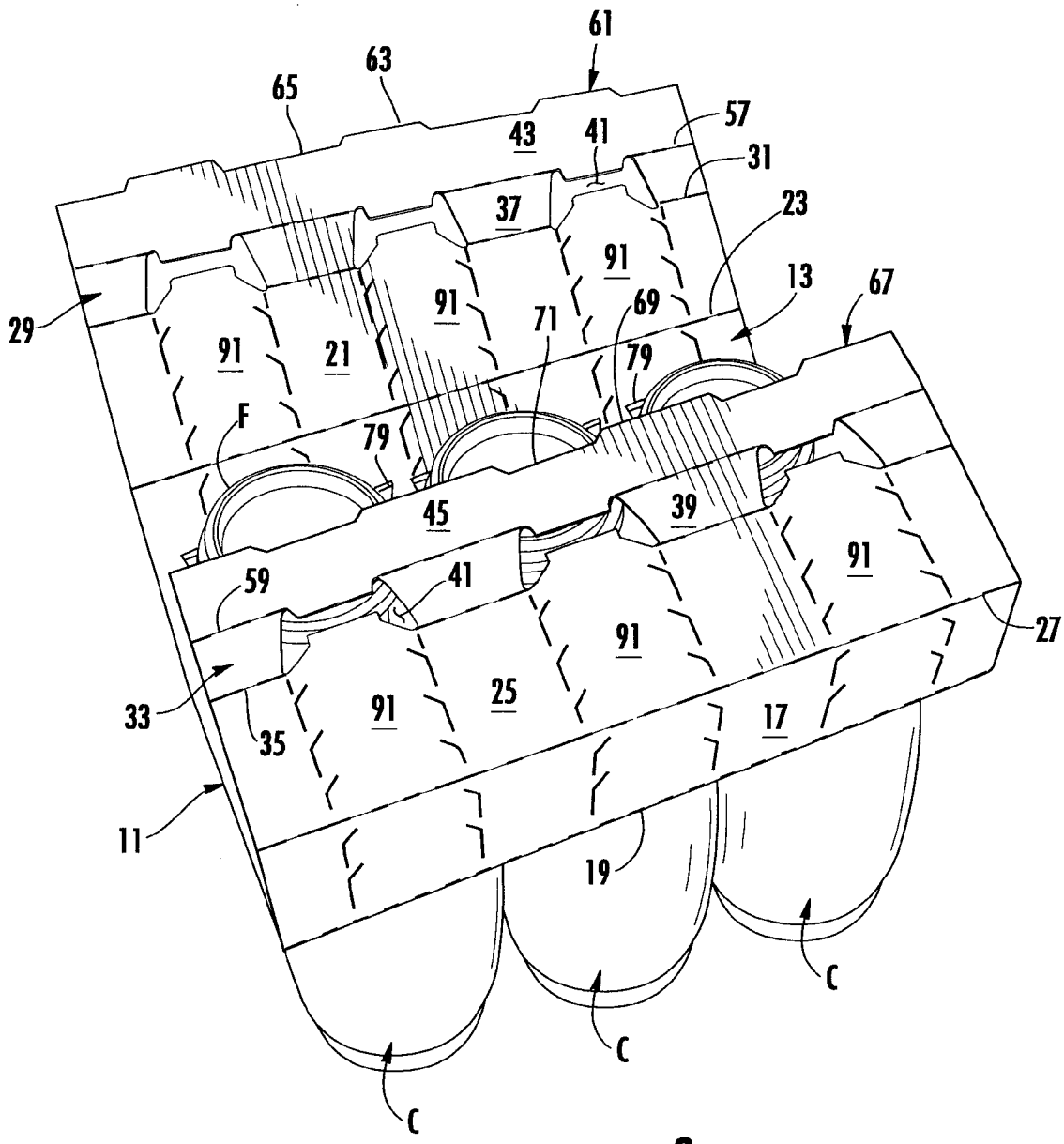
Figure 4:
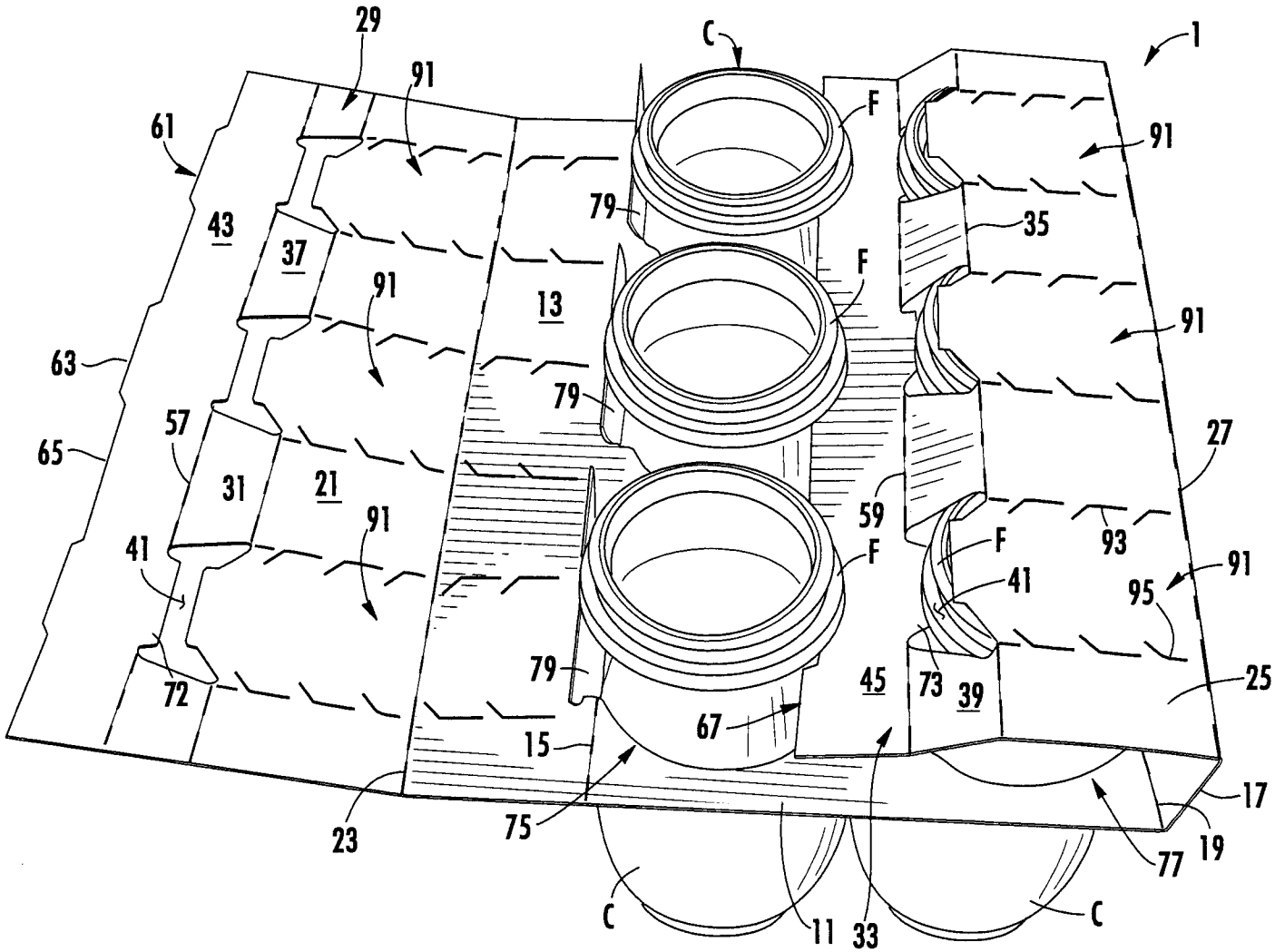
Figure 5:
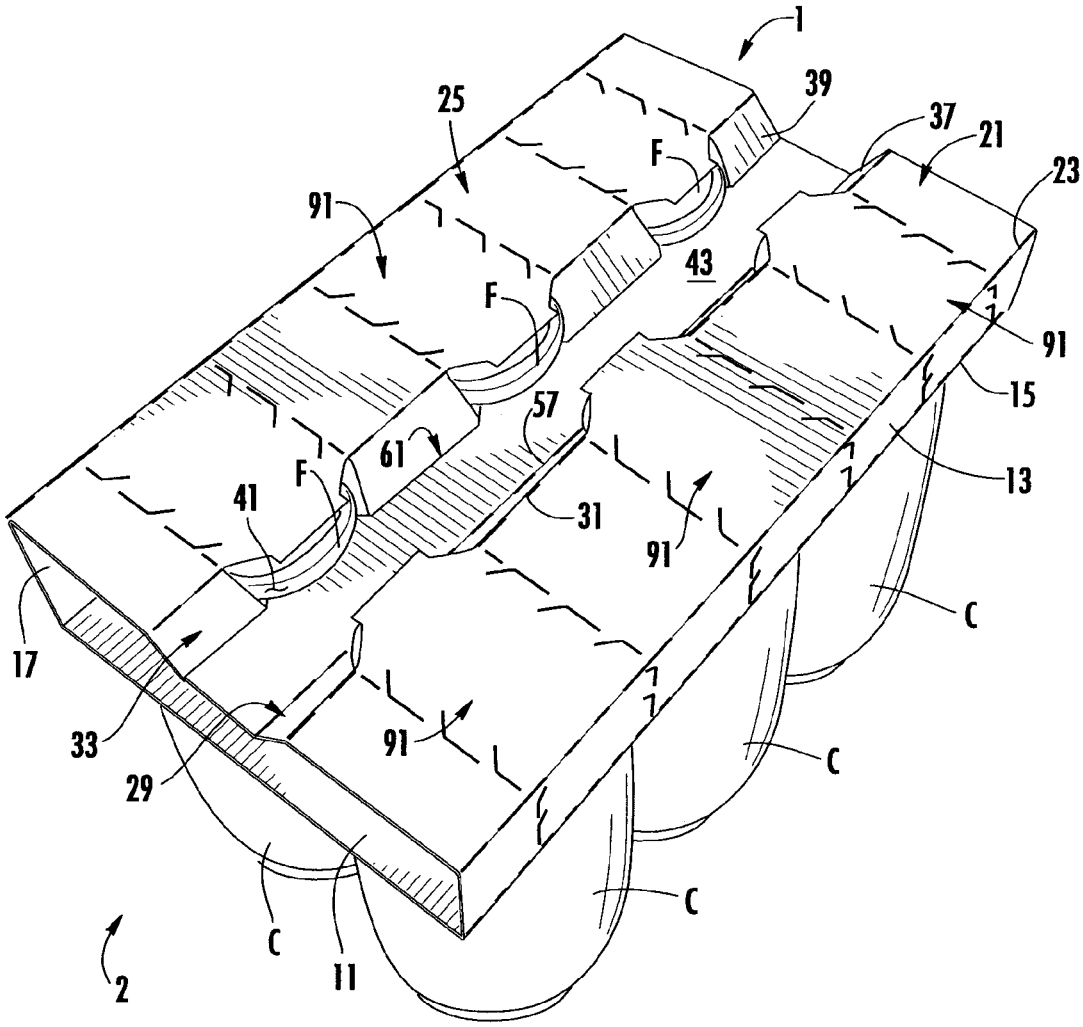
FIGS. 5-8 are perspective views of the package according to the first embodiment of the disclosure.
Figure 6:
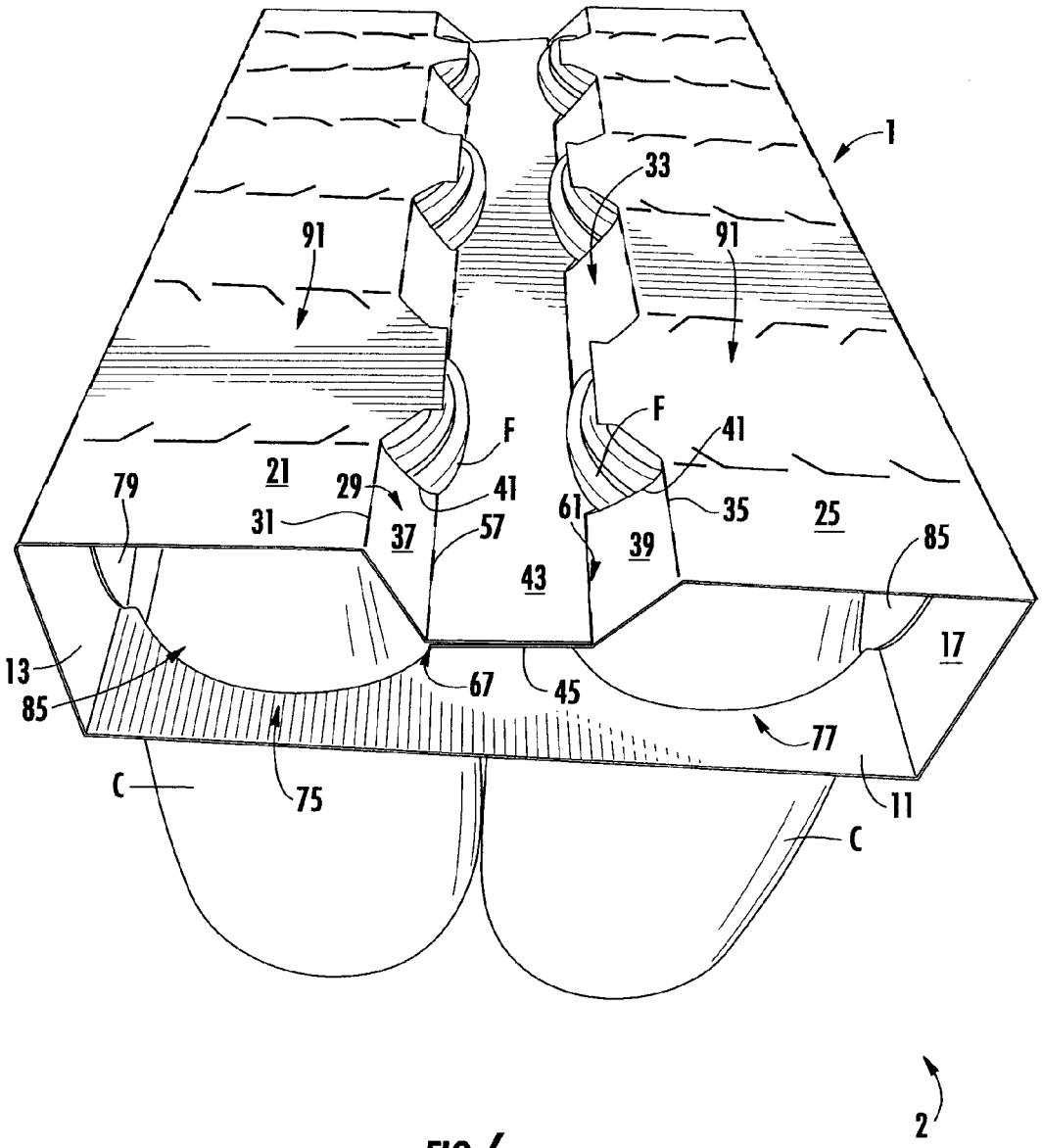
Figure 7:
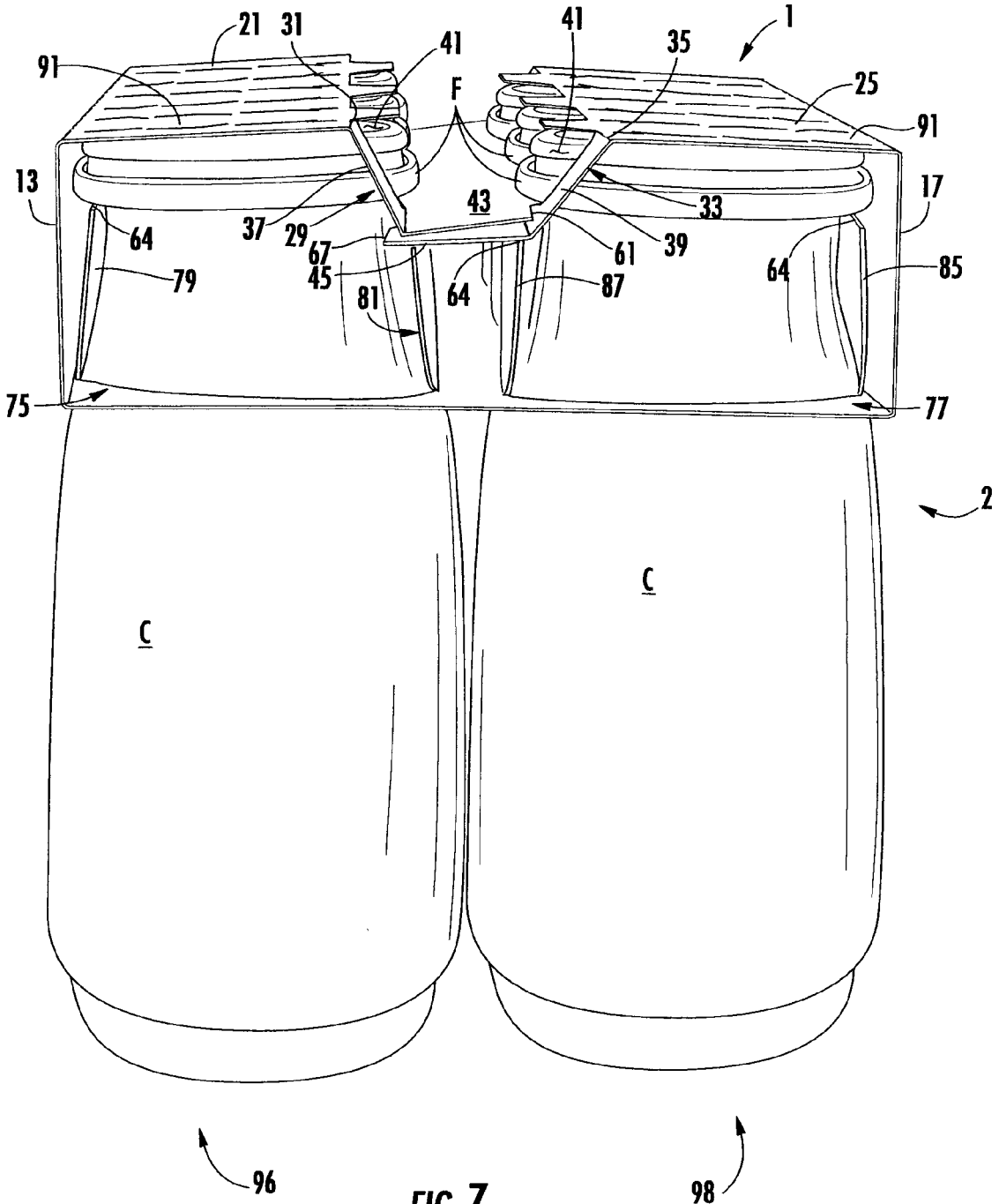
Figure 8:
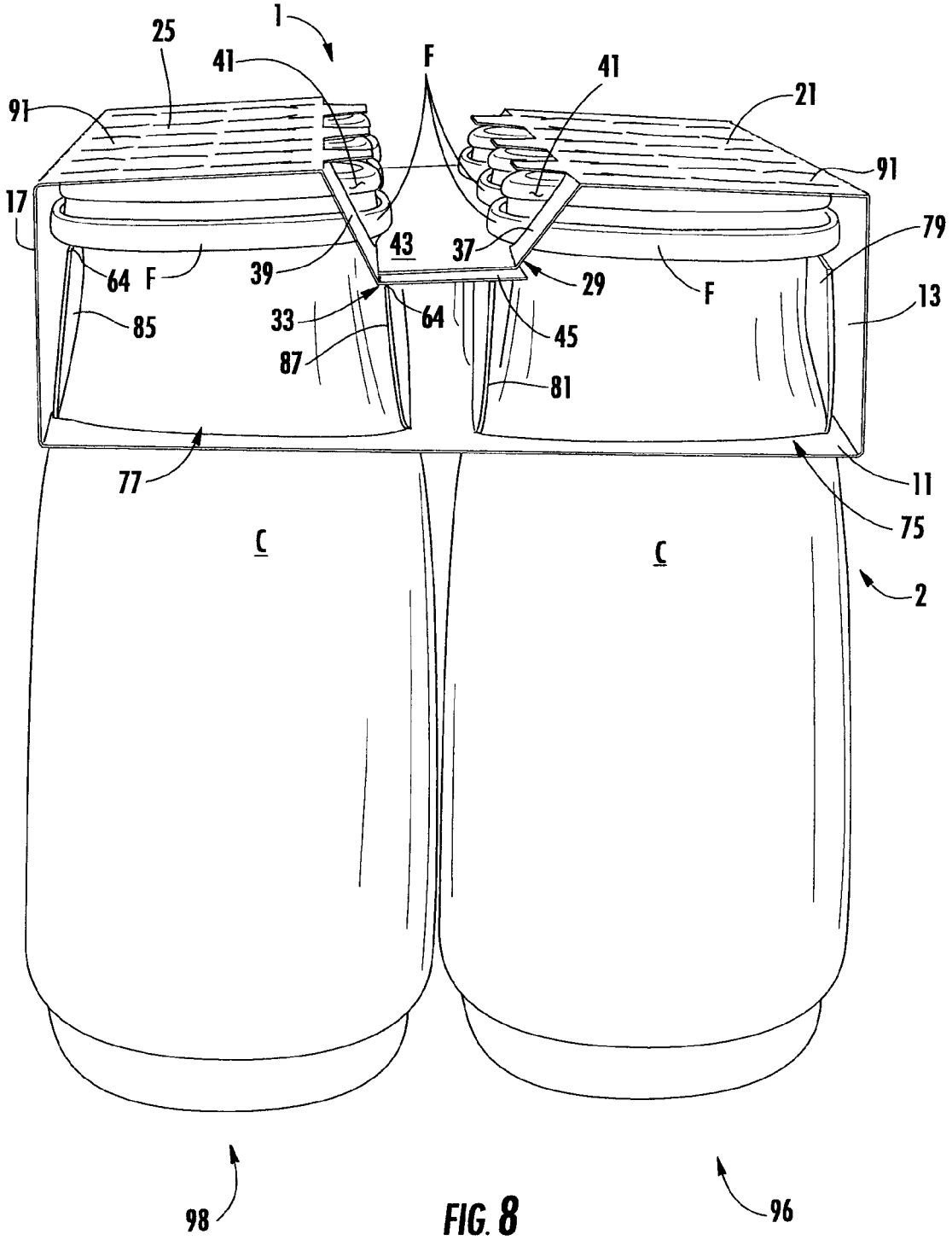

Referring to FIGS. 2-5, an exemplary method of forming the blank 8 into the carrier is described in the following. In one exemplary embodiment, the blank 8 can be formed into the carrier 1 by inserting the containers C through a respective container-receiving pattern 75, 77. Upon inserting a container C into a respective pattern 75, 77, the first brace flaps 79, 85 and second brace flaps 81, 87 are upwardly folded as the top of the container C moves upward relative to the bottom panel 11. The containers C can be inserted into the respective first container-receiving patterns 75 in a first column 96, and the containers C can be inserted into the respective second container-receiving patterns 77 in a second column 98. As shown in FIG. 2, the free edges 64 of the respective pairs of brace flaps 79, 85 and 81, 87 engage the underside of a respective one of the flanges F of a respective one of the containers C. The side panels 13, 17 can be upwardly folded relative to the bottom panel 11 at respective fold lines 15, 19. The top panels 21, 25 are folded relative to the side panels 13, 17 at respective fold lines 23, 27 so the top panels are placed over the tops of the containers C and can be in face-to-face contact with the flat tops of the containers. In one embodiment, the retention flaps 29, 33 can be downwardly folded relative to the top panels 21, 25 at respective fold lines 31, 35. When the retention flaps 29, 33 are positioned as shown in FIG. 7, a portion of the flange F of each container C is received in a respective opening 41 in the first portion 37, 39 of each of the retention flaps. As shown in FIG. 7, each of the first portions 37, 39 of the retention flaps 29, 33 are positioned at an oblique angle relative to the top panels 21, 25. In one embodiment, each of the protrusions 63 of the retention portion 43 of the first retention flap 29 engages a respective flange F of the containers C in the second column 98, each of the tabs 72 of the retention portion 43 engages a respective flange F of the containers in the first column 96, and the bottom retention portion (e.g., 45 in the embodiment of FIG. 9) can extend across, and can be support by, the adjacent inner brace flaps 81, 87.

The carrier 1 formed from the blank 8 retains the containers C securely and reduces pivoting and other movement of the containers when the package 2 is grasped and carried. Further, the retention flaps 29, 33 are held tight underneath the flange F of the containers C so that the containers are held in the carrier without the need for the application of glue or other adhesive to any of the panels or flaps of the blank 8.

Figure 9:
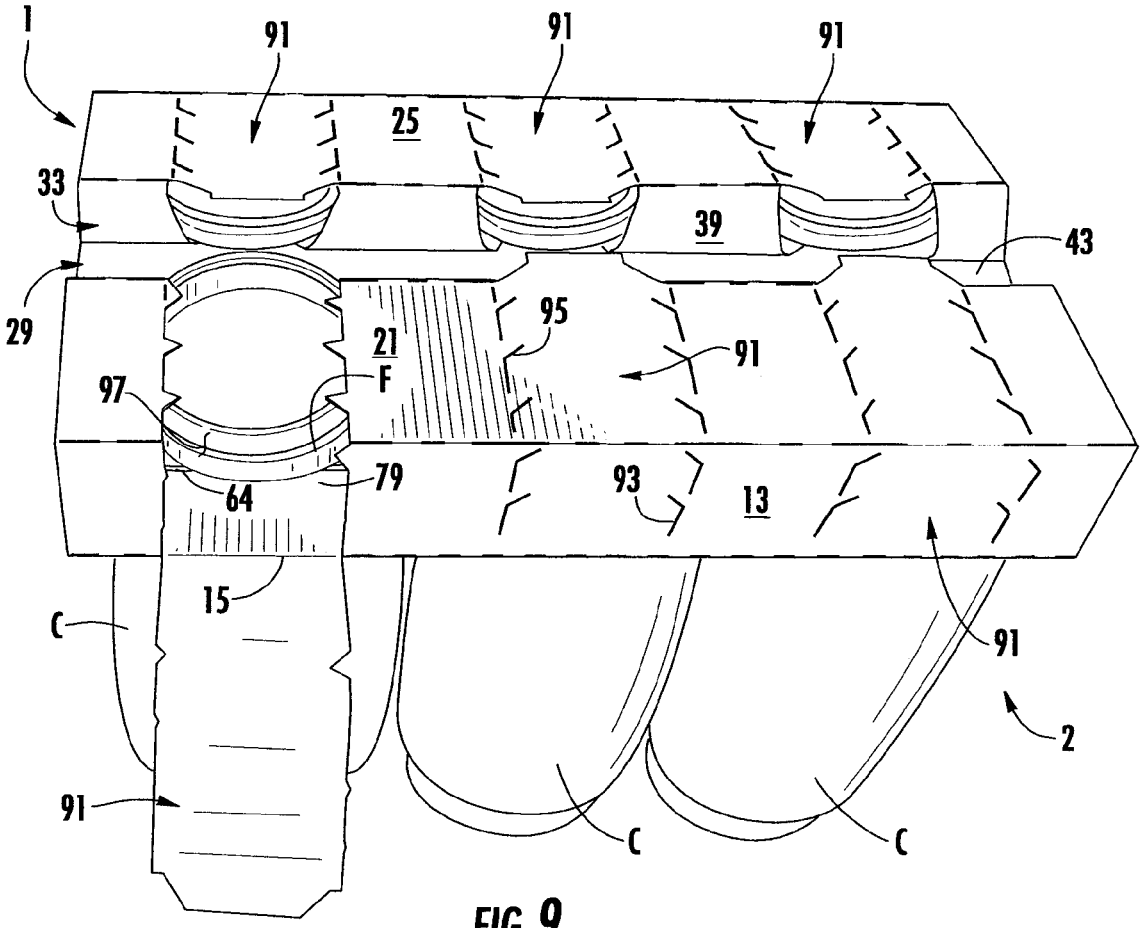
FIGS. 9 and 10 are perspective views showing the activation of an opening feature and removal of a container according to the first embodiment of the disclosure.
Figure 10:
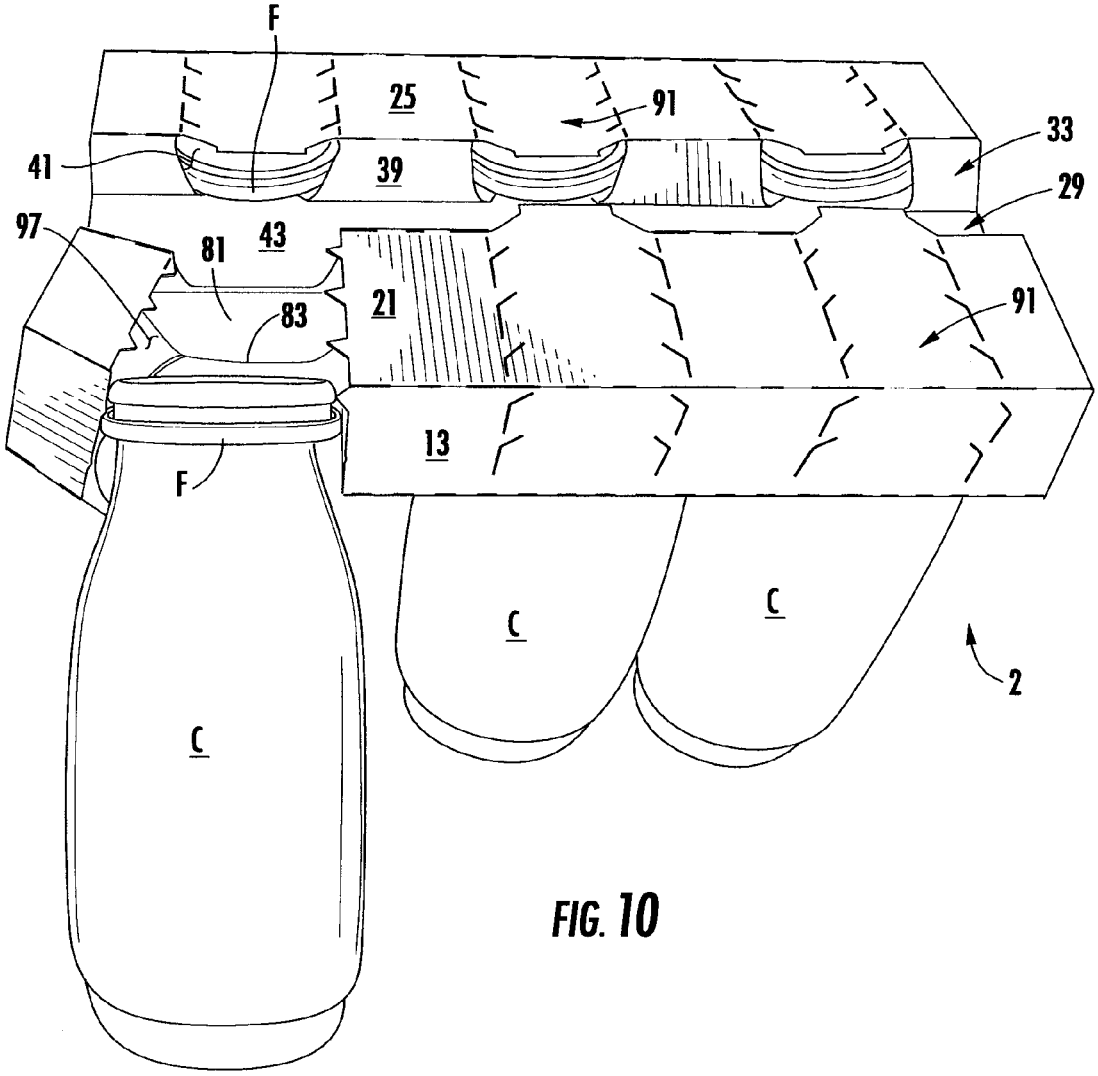

As shown in FIGS. 9 and 10, one or more of the opening features 91 can be activated to remove one or more containers C from the package 2. The tear strip 91 can be grasped at the opening 41 to tear the opening feature at the tear lines 93, 95 to create a dispenser opening 97 in the carrier 1. In one embodiment, the adjacent first brace flap 79 can be torn away from the remainder of the carrier with the tear strip 91 (FIG. 10). Once the dispenser opening 97 is created, a container C can be grasped and removed from the dispenser opening. The carrier 1 can have other dispensing or opening features, or the dispensing and opening features can be omitted without departing from the disclosure.

Figure 11:
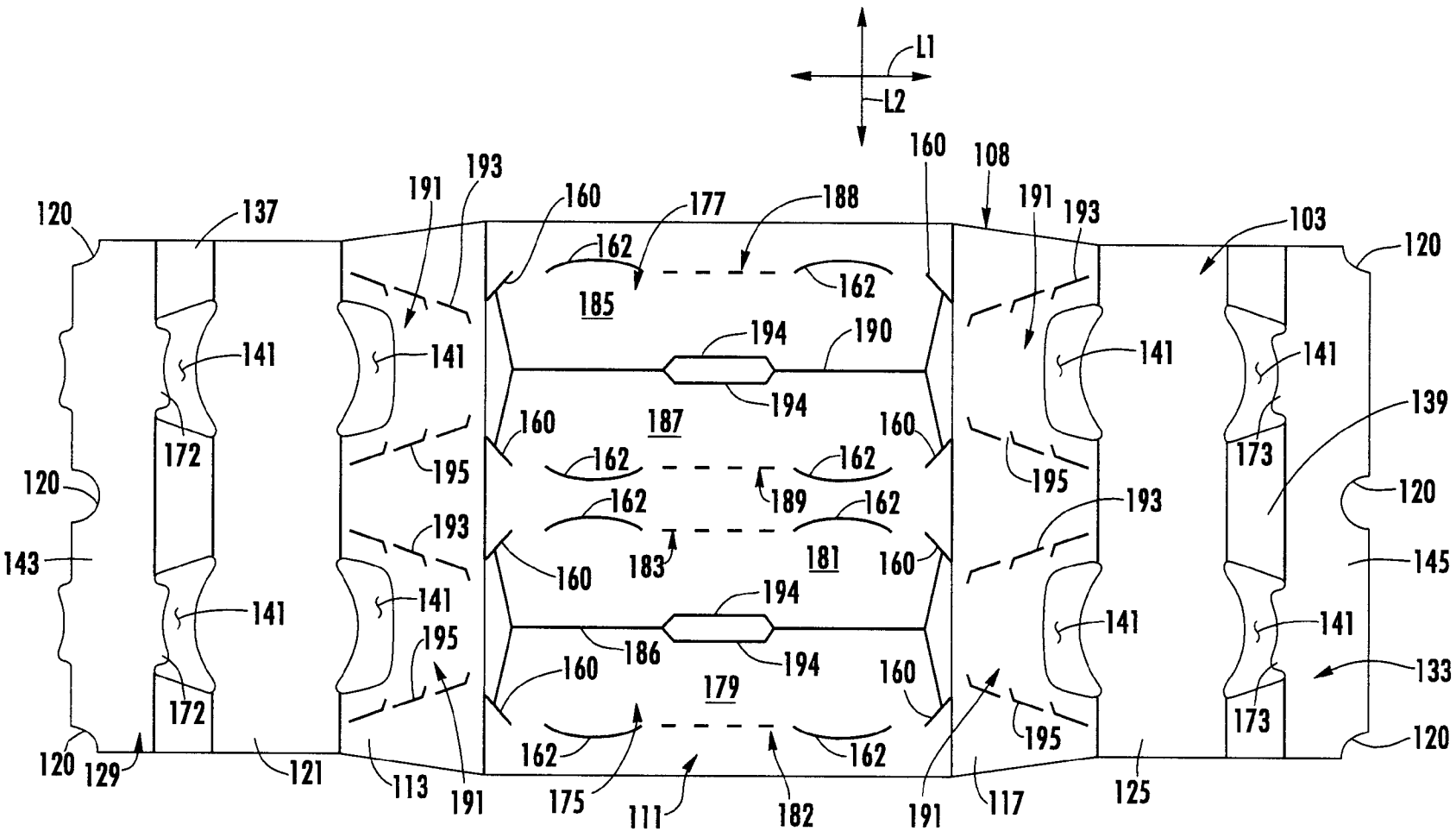
FIG. 11 is an exterior plan view of a blank for forming a package according to a second embodiment of the disclosure.
Figure 13:
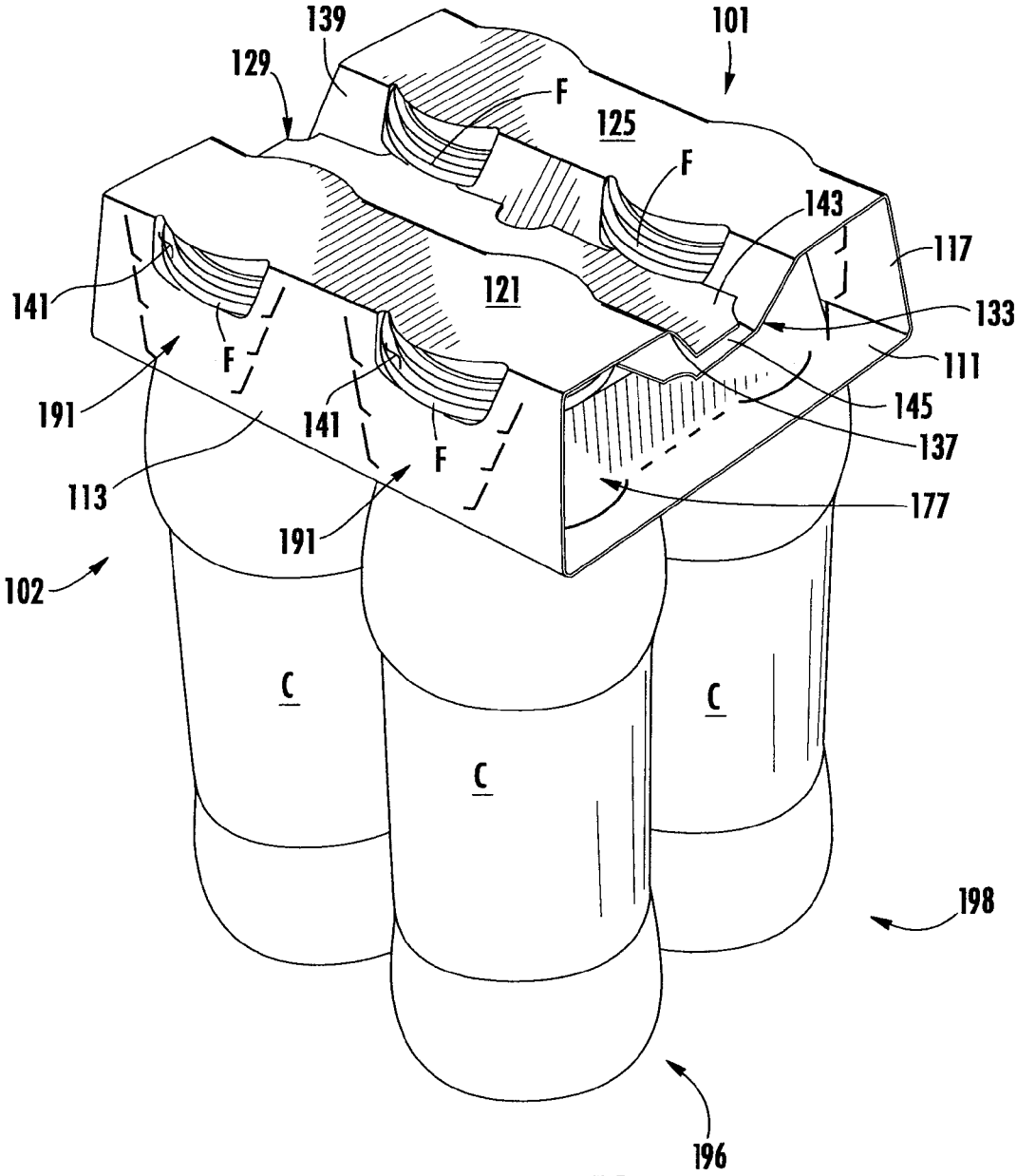
FIG. 13 is a perspective view of the package according to the second embodiment of the disclosure.

FIG. 11 is a plan view of the exterior side 103 or printed side of a blank 108 of a second embodiment, similar to the blank 8 of the first embodiment. The blank 108 is used to form a carrier 101 and a package 102, which includes the carrier 101 and a plurality of containers C retained in the carrier 101 (FIG. 13), according to the second embodiment of the disclosure. Like or similar reference numbers are used to designate like or similar components of the blank 108 and the blank 8 of the first embodiment.

In one embodiment, the bottom panel 111 of the blank 108 includes a first container-receiving pattern 175 and a second container-receiving pattern 177. Each of the container-receiving patterns 175, 177 extend generally in the longitudinal direction of the blank and accommodate two containers C. The container-receiving pattern 175 has brace flaps 179, 181 that are respectively foldably connected to the bottom panel 111 at respective fold lines 182, 183 and are separable along a cut line 186. The container-receiving pattern 177 has brace flaps 185, 187 that are respectively foldably connected to the bottom panel 111 at respective fold lines 188, 189 and are separable along a cut line 190. The brace flaps 179, 181, 185, 187 can be further defined by oblique cut lines 160 and curved cuts 162. In one embodiment, the oblique cut lines 160 provide enlarged portions of the bottom panel 111 proximate the side panels 113, 117 to strengthen the corners of the carrier. The cuts 162 can allow the brace flaps 179, 181, 185, 187 to partially conform to the curved sides of the containers C. The brace flaps 179, 181 of the container-receiving pattern 175 can be separable along a cut line 186, and the brace flaps 185, 187 of the container-receiving pattern 177 can be separable along a cut line 190. Each of the cut lines 186, 190 can include recesses 194 for receiving one or both of the retaining portions 143, 145.

In the embodiment of FIG. 11, the side panels 113, 117 include respective openings 141. As with the first embodiment, the retention flaps 129, 133 have respective openings 141. Also, the retention flaps 129, 133 have respective proximal or first portions 137, 139 that are foldably connected to respective top panels 121, 125 and respective distal or second (retaining) portions 143, 145 that are foldably connected to the respective first portions 137, 139. The retaining portion 143 can include a tab 172 adjacent each of the openings 141 in the retention flap 129, and the retaining portion 145 can include a tab 173 adjacent each of the openings 141 in the retention flap 133.

In the embodiment of FIG. 11, the blank 108 includes opening features 191 in the side panels 113, 117. The opening features 191 comprise two spaced-apart, oblique tear lines 193, 195 in a respective side panel 113, 117. The opening features 191 could be otherwise shaped, arranged, and/or omitted without departing from the disclosure.

Figure 12:
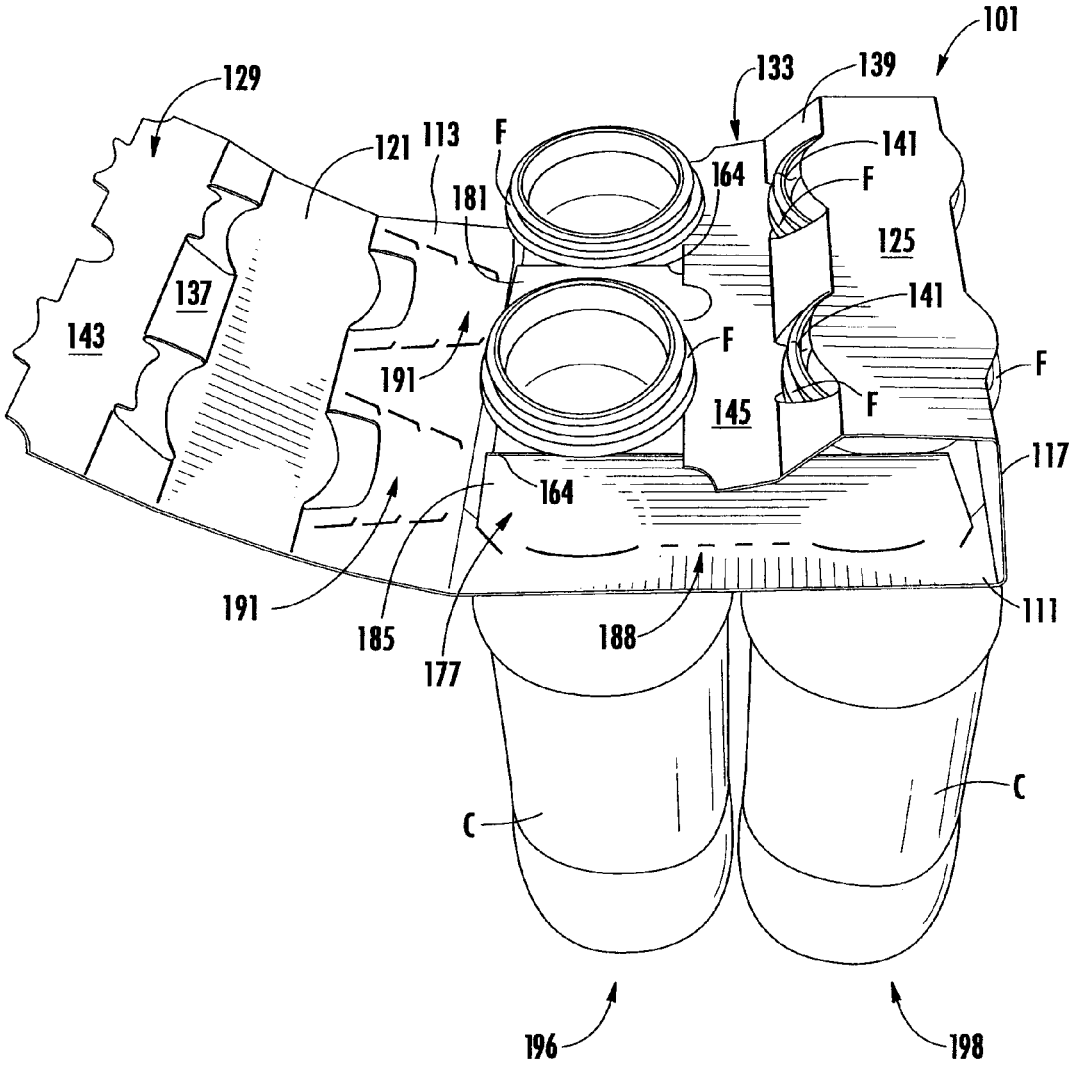
FIG. 12 is a perspective view showing the erection of the package according to the second embodiment of the disclosure.

The carrier 101 of the second embodiment is formed from the blank 108 in a similar manner as the carrier 1 of the first embodiment. As shown in FIG. 12, containers C are inserted through the container-receiving patterns 175, 177 so that the flanges F are engaged by the respective pairs of upwardly folded brace flaps 179, 181 and 185, 187 at the respective upper edges 164. In the second embodiment, two containers C are placed through each container-receiving pattern 175, 177, one container C in a first column 196 adjacent the first side panel 113 and one container C in a second column 198 adjacent the second side panel 117. Alternatively, more or less than two containers could be placed through each container-receiving pattern without departing from the scope of this disclosure.

After placing the containers C through container-receiving patterns 175, 177, the side panels 113, 117 can be folded relative to the bottom panel 111 and the top panels 121, 125 can be folded relative to the side panels so that the top panels are in face-to-face contact with the top of the containers. Next, one of the retention flaps 129, 133 is downwardly folded to engage the flanges F of the containers C in a similar manner as described above for the first embodiment. One or both of the retaining portions 143, 145 of the respective retention flaps 129, 133 can be received in the recesses 194 in the upper edges 164 of the brace flaps 179, 181, 185, 187. As with the first embodiment, the containers C are secured in the carrier 101 without the need for the application of glue or other adhesive to any of the panels or flaps of the carrier.

One or more of the containers C can be removed from the package 102 by activating the opening features 191 to create a dispenser opening (not shown) in a respective side panel 116, 117.

Figure 14:
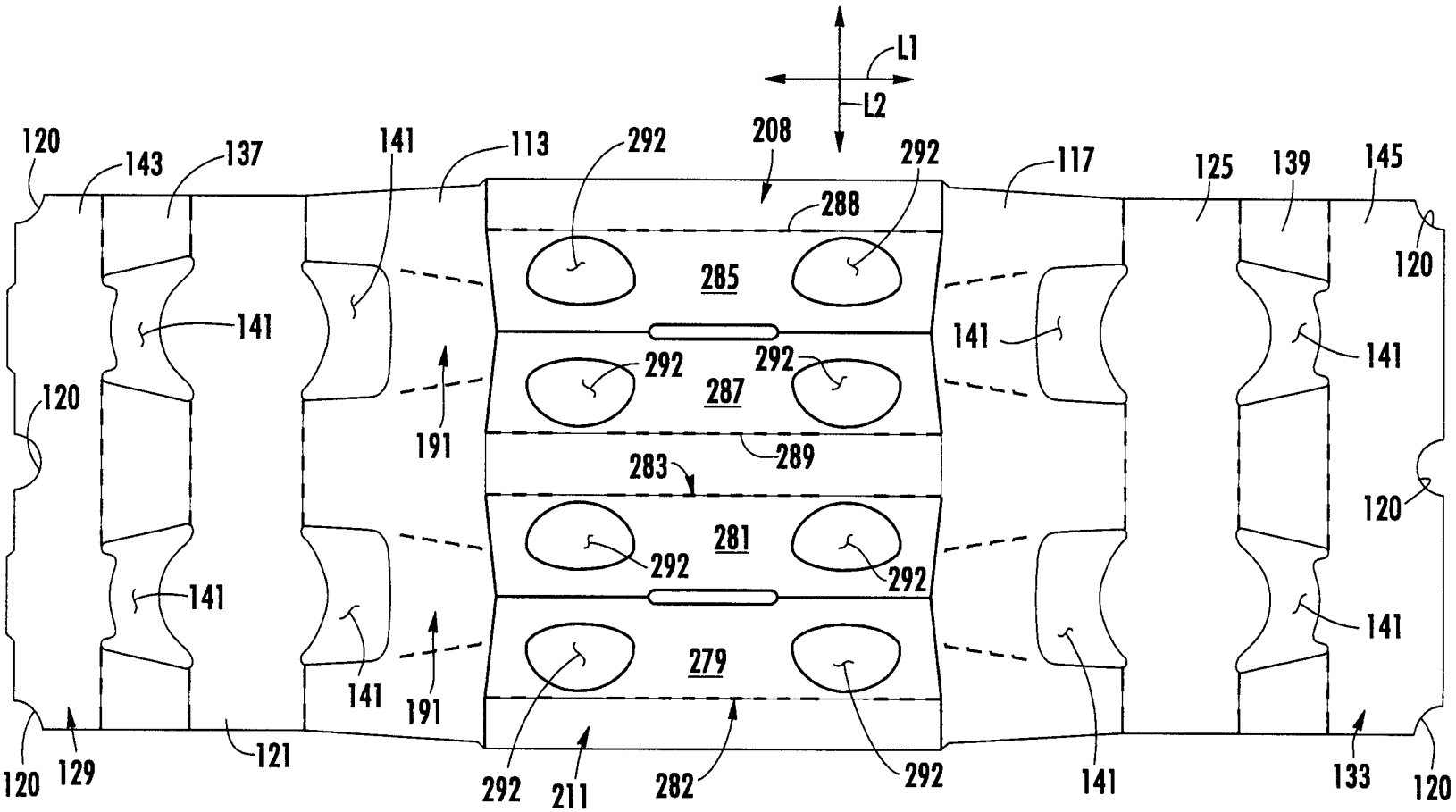
FIG. 14 is an exterior plan view of a blank for forming a package according to a third embodiment of the disclosure.
Figure 15:
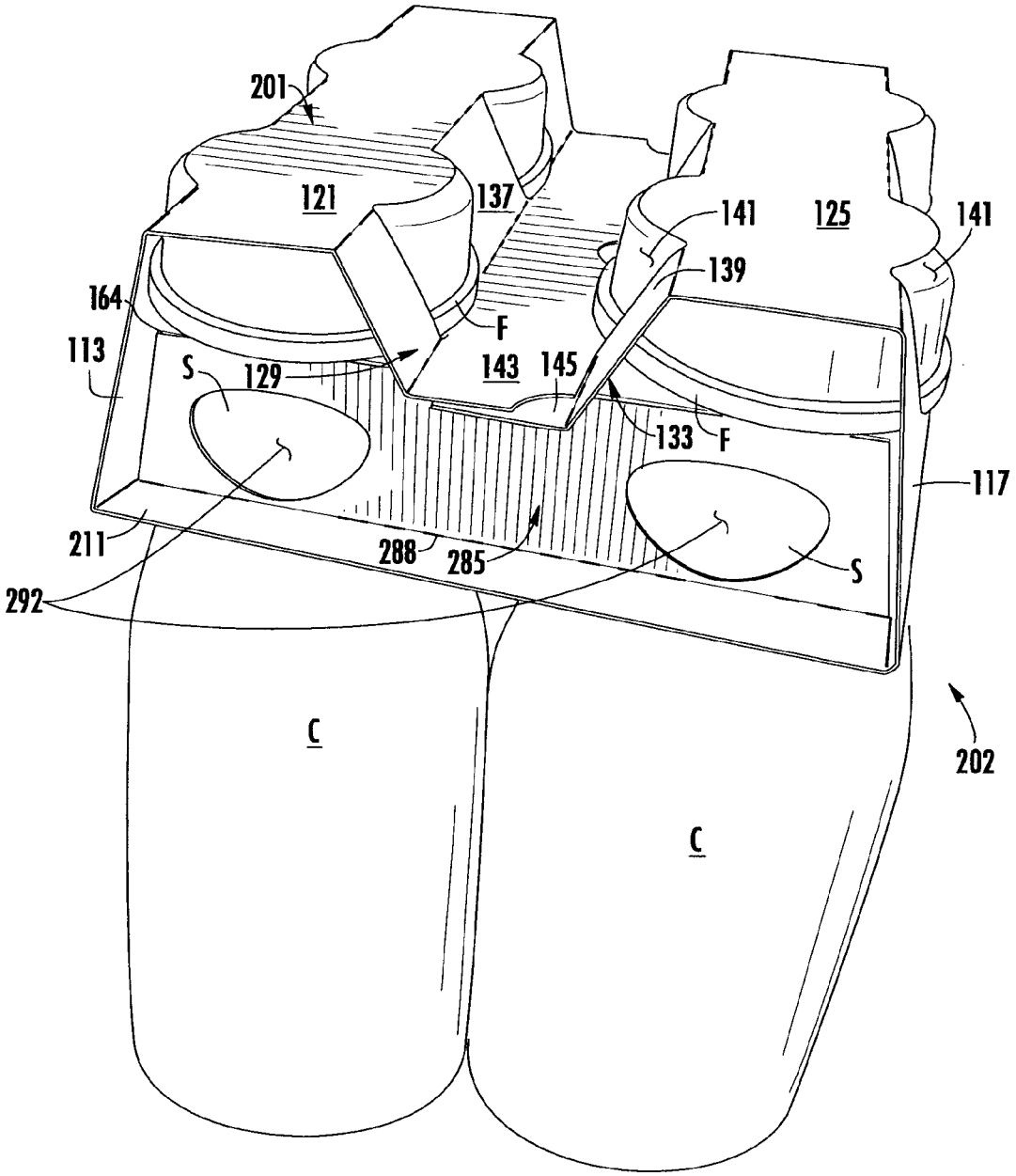
FIG. 15 is a perspective view of the package according to the third embodiment of the disclosure.

FIG. 14 shows a third embodiment of a blank 208 similar to the blank 108 of the previous embodiment. Accordingly, like or similar reference numbers are used to indicate like or similar features. The blank 208 can be formed into the carrier 201 and a package 202, which includes the carrier 201 and a plurality of containers C retained in the carrier 201 (FIG. 15). In the embodiment of FIGS. 14 and 15, the bottom panel has brace flaps 279, 281, 285, 287 similar to the brace flaps of the previous embodiment. The brace flaps 279, 281, 285, 287 are foldably connected to the bottom panel 211 at respective fold lines 282, 283, 288, 289. The brace flaps 279, 281, 285, 287 have respective openings 292.

As shown in FIG. 15, when the blank 208 is formed into the carrier 201, the openings 292 are shaped and positioned to receive a respective shoulder S of the containers. The openings 292 in the brace flaps 279, 281, 285, 287 increases the stability of the containers C held in the carrier 201 by providing an additional contact point with the containers C. The openings 292 can be otherwise shaped, arranged, configured, and/or omitted without departing from this disclosure.

Figure 16:
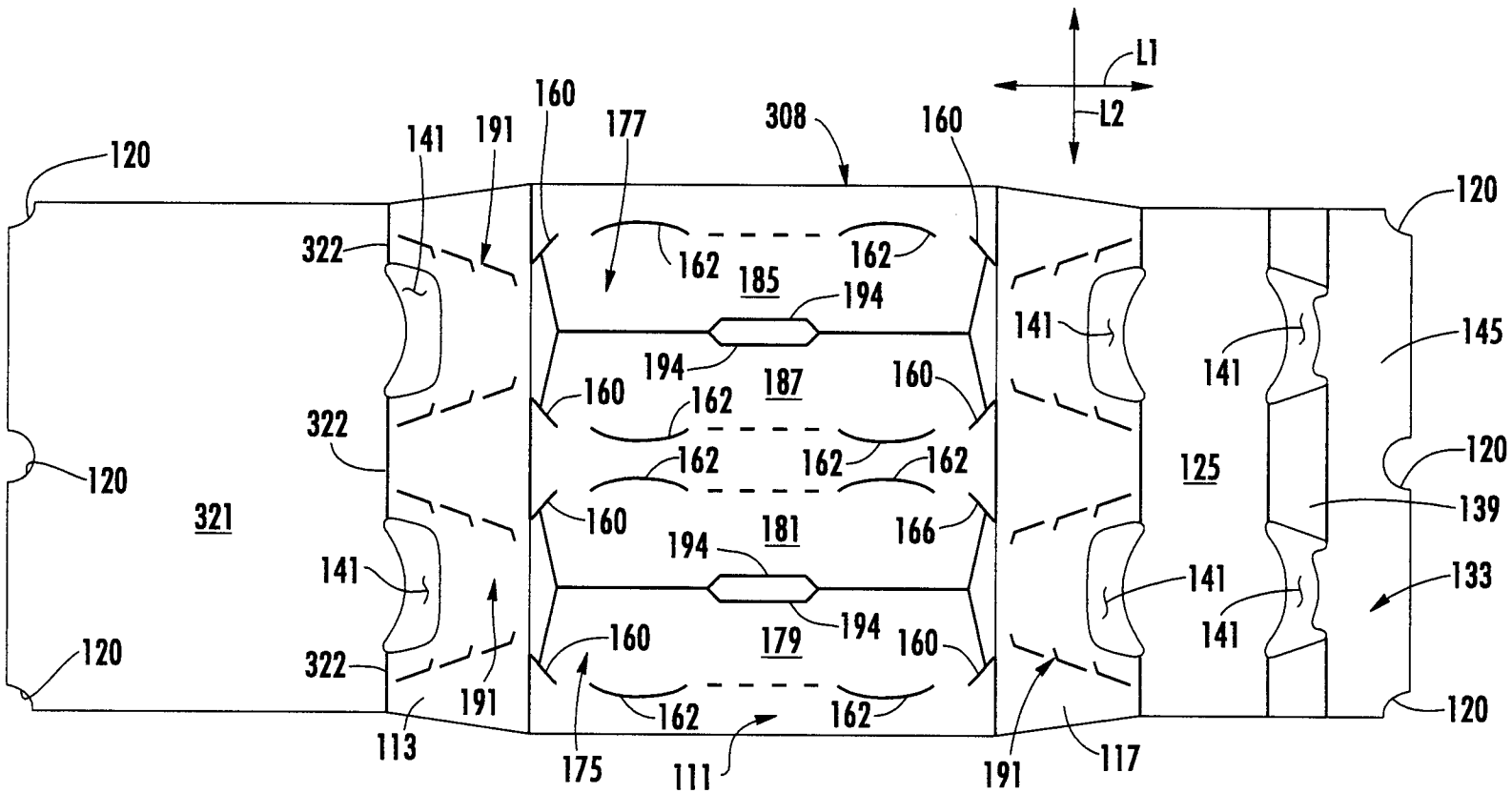
FIG. 16 is an exterior plan view of a blank for forming a package according to a fourth embodiment of the disclosure.

FIG. 16 is a plan view of a blank 308 used to form a carrier 301 (FIGS. 17-20) and a package 302, which includes the carrier 301 and a plurality of containers C retained in the carrier 301 (FIGS. 18-20), according to a fourth embodiment of the disclosure. The blank 308 is similar to the blank 108 illustrated in FIG. 11 and discussed above, and like or similar reference numerals may indicate like or similar elements in the figures. The blank 308 includes a bottom panel 111, first side panel 113, second side panel 117, second top panel 125, and retention flap 133 that are similar to the blank 108 of the second embodiment. The blank 308 has a first top panel 321 foldably connected to the first side panel 113 at spaced-apart lateral fold lines 322 that extend from openings 141 in the first side panel.

Figure 17:
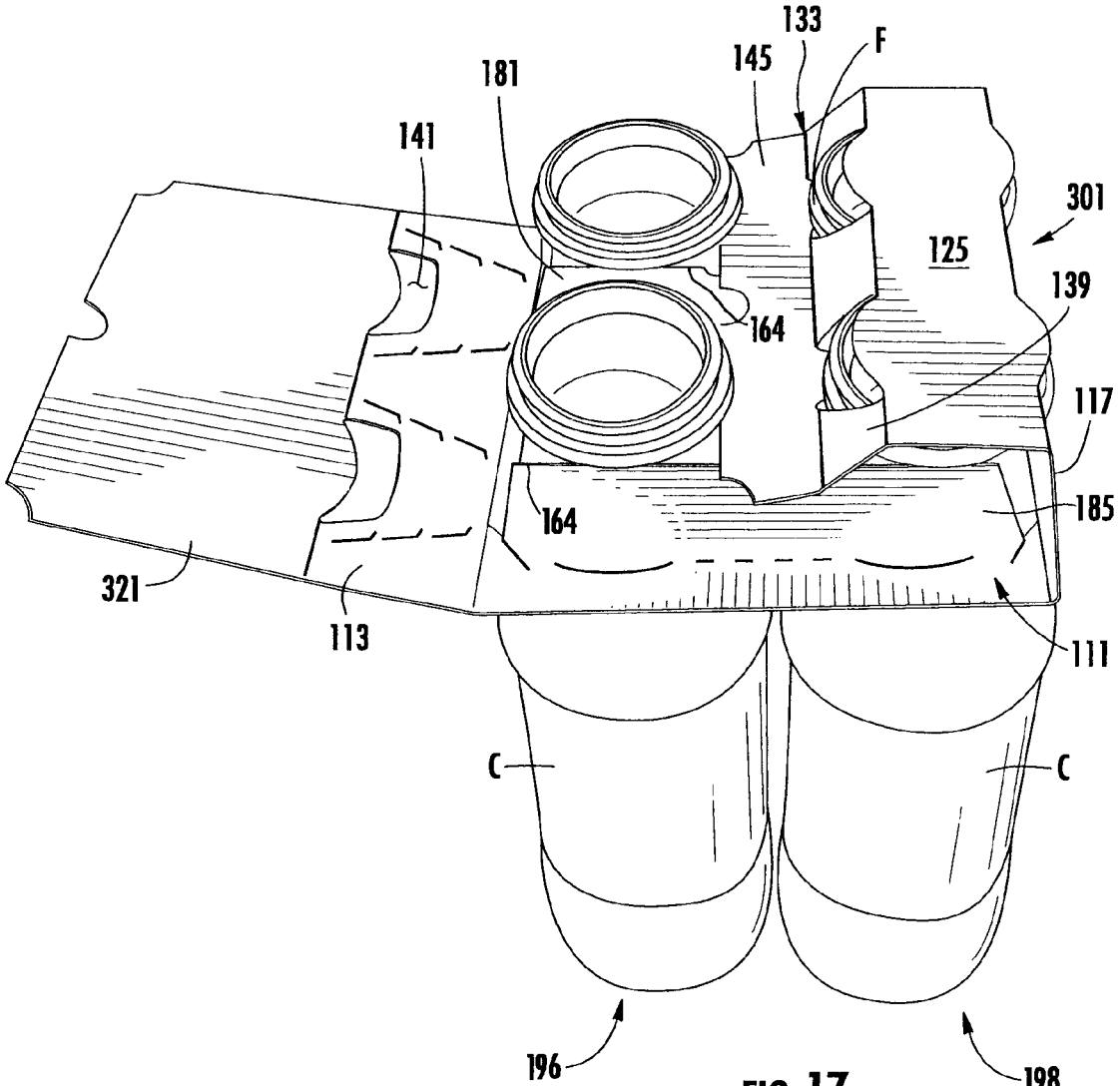
FIG. 17 is a perspective view showing the erection of the package according to the fourth embodiment of the disclosure.
Figure 18:
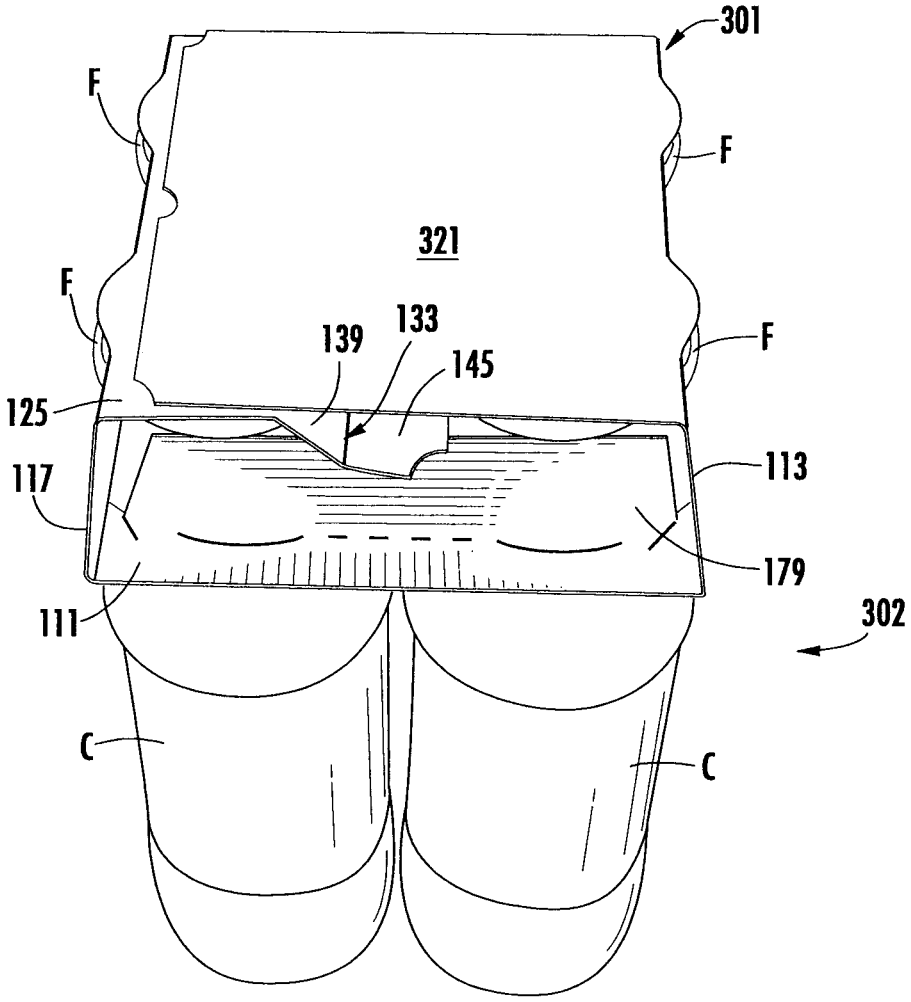
FIGS. 18-20 are perspective views of the package according to the fourth embodiment of the disclosure.
Figure 19:
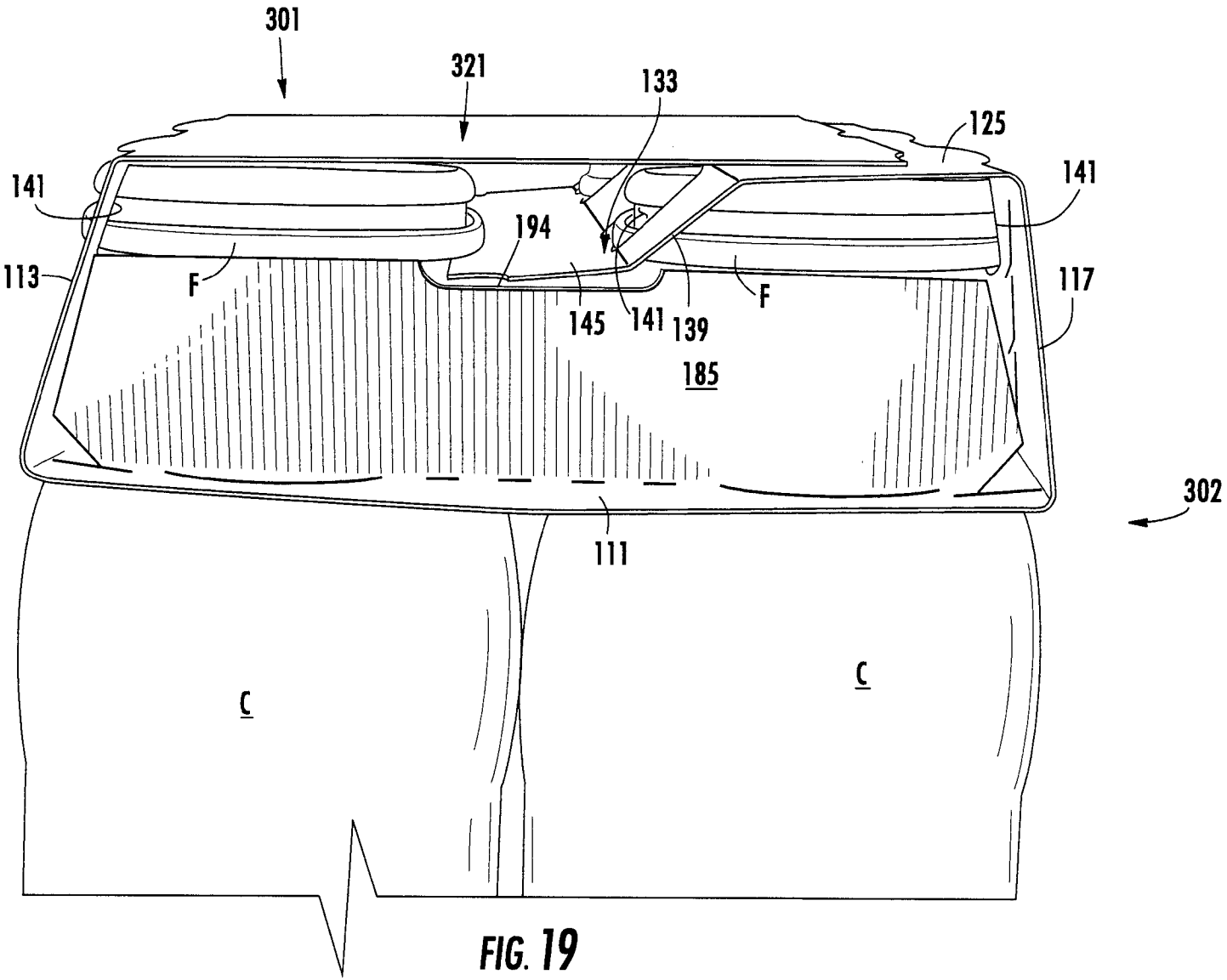
Figure 20:
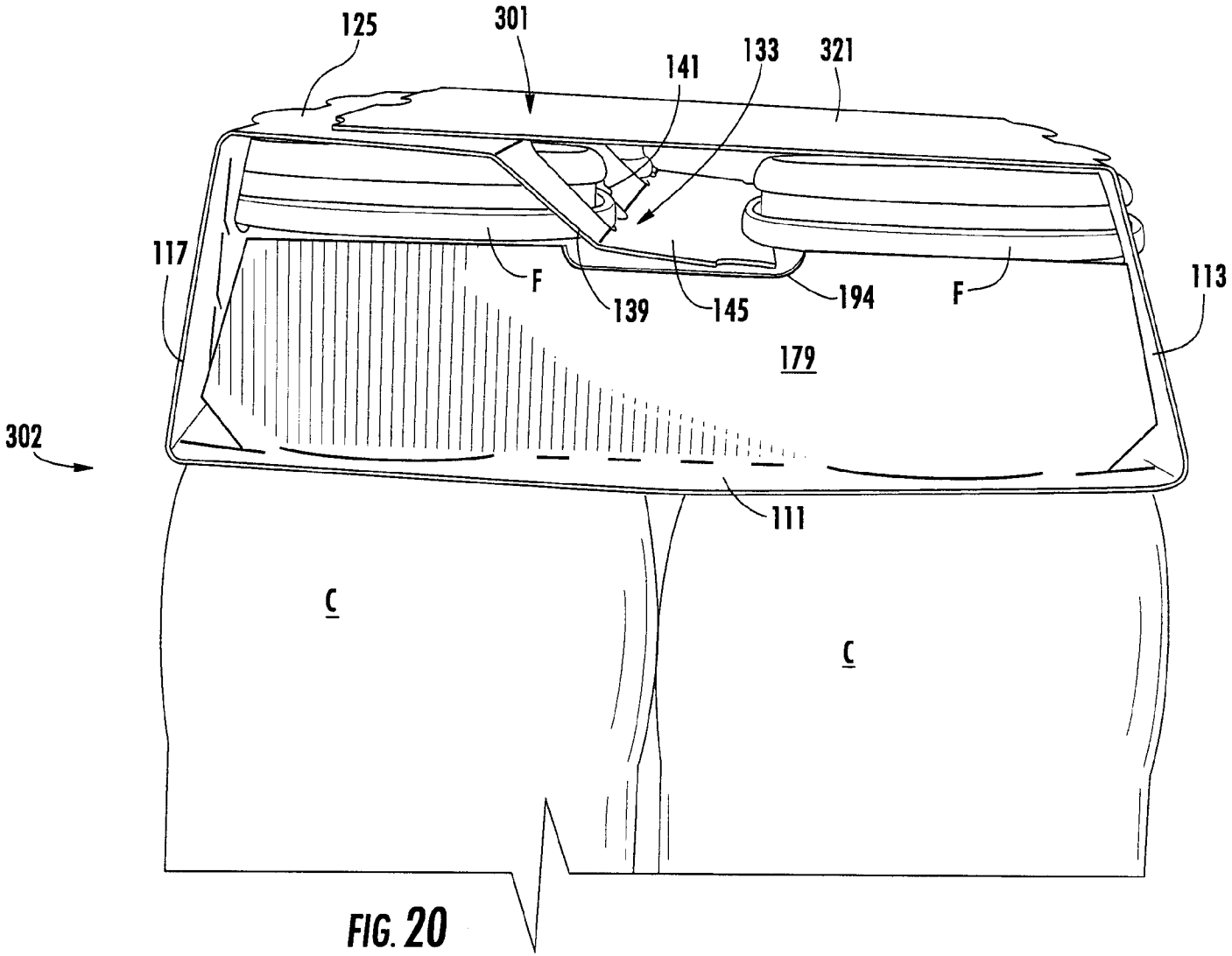

In the embodiment of FIGS. 16-20, the package 302 is formed in a similar manner as the previous embodiments. The containers C are inserted through the container-receiving openings 175, 177 so that the containers engage respective free edges of the brace flaps 179, 181, 185, 187, and the retention flap 133 is positioned to engage the undersides of the flanges F of the containers C in the first and second columns 196, 198 (FIG. 17). The recesses 194 can at least partially receive the retention flap 133, as shown in FIGS. 19 and 20. Next, the first top panel 321 can be folded relative to the first side panel 113 so that the first top panel overlaps the tops of the containers adjacent the first side panel and overlaps and is in at least partial face-to-face contact with the second top panel 125 (FIGS. 18-20). The first top panel 321 can be secured to the second top panel 125 by adhesive such as glue. The carrier 301 can be formed by other panel or flap positioning steps or other methods that are different than the steps or methods described herein.

Figure 21:
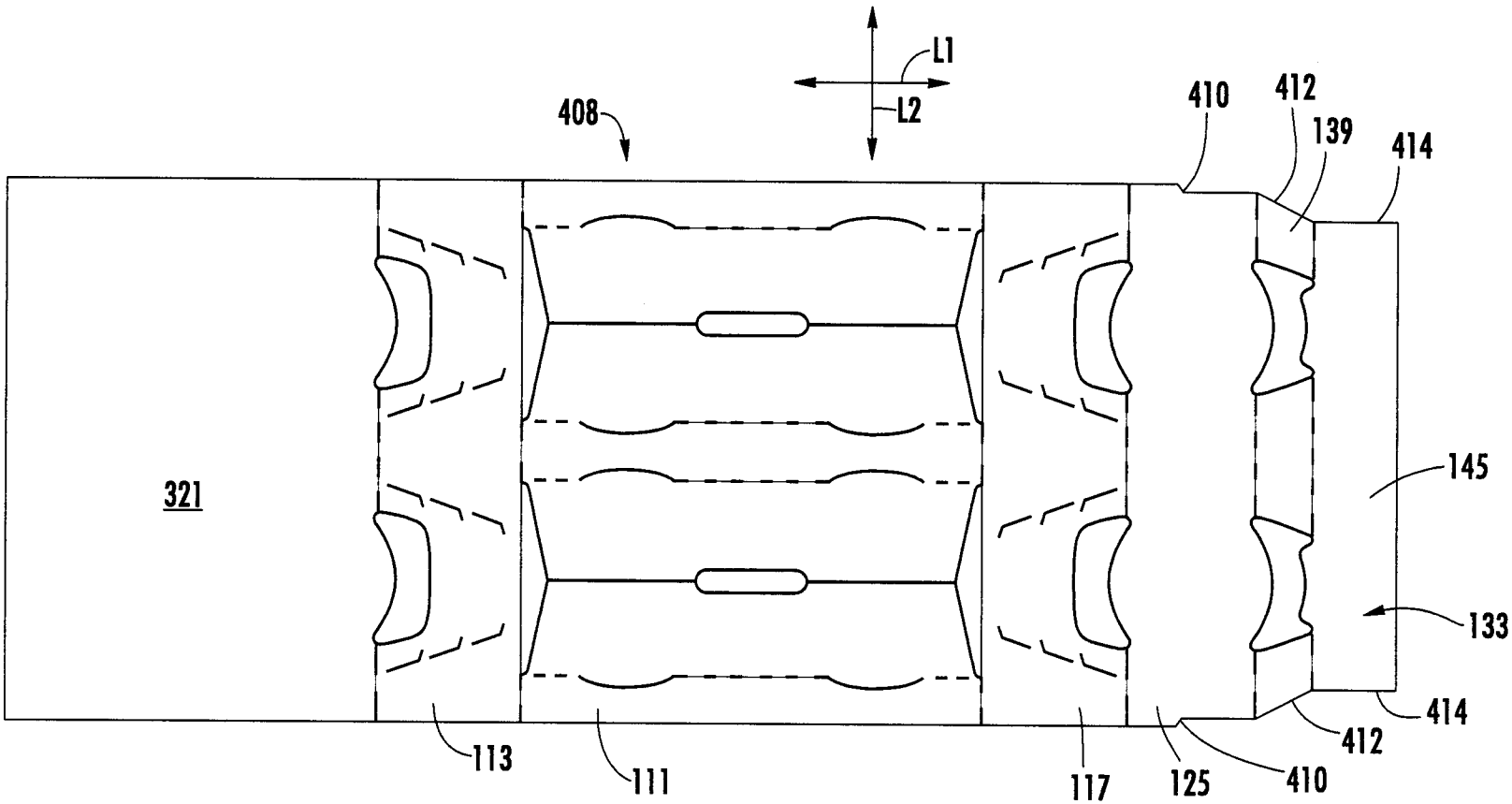
FIG. 21 is an exterior plan view of a blank for forming a package according to a fifth embodiment of the disclosure.

FIG. 21 is a plan view of a blank 408 used to form a carrier (not shown) according to a fifth embodiment. The blank 408 has similar features as the blank 308 of the previous embodiment and like or similar references numbers are used to indicate like or similar features. The second top panel 125 has a respective shoulder 410 at each lateral end of the second top panel. The first portion 139 of the retention flap 133 has respective oblique edges 412 that taper to the longitudinally extending edges 414 of the second portion 145 of the retention flap. The blank 408 could be otherwise shaped, arranged, and could have other features as described with the other embodiments herein, or other features that are not described herein.

Figure 22:
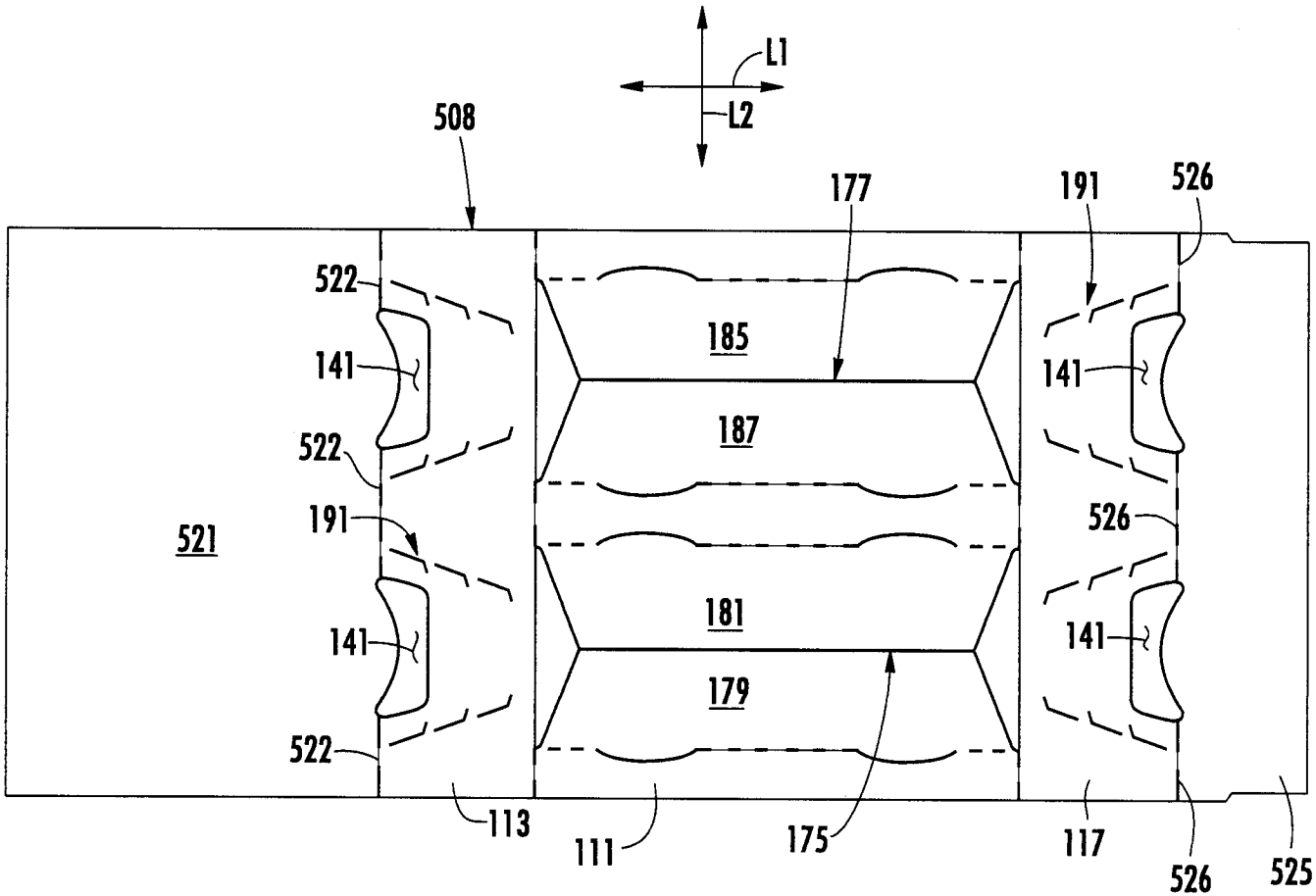
FIG. 22 is an exterior plan view of a blank for forming a package according to a sixth embodiment of the disclosure.
Figure 25:
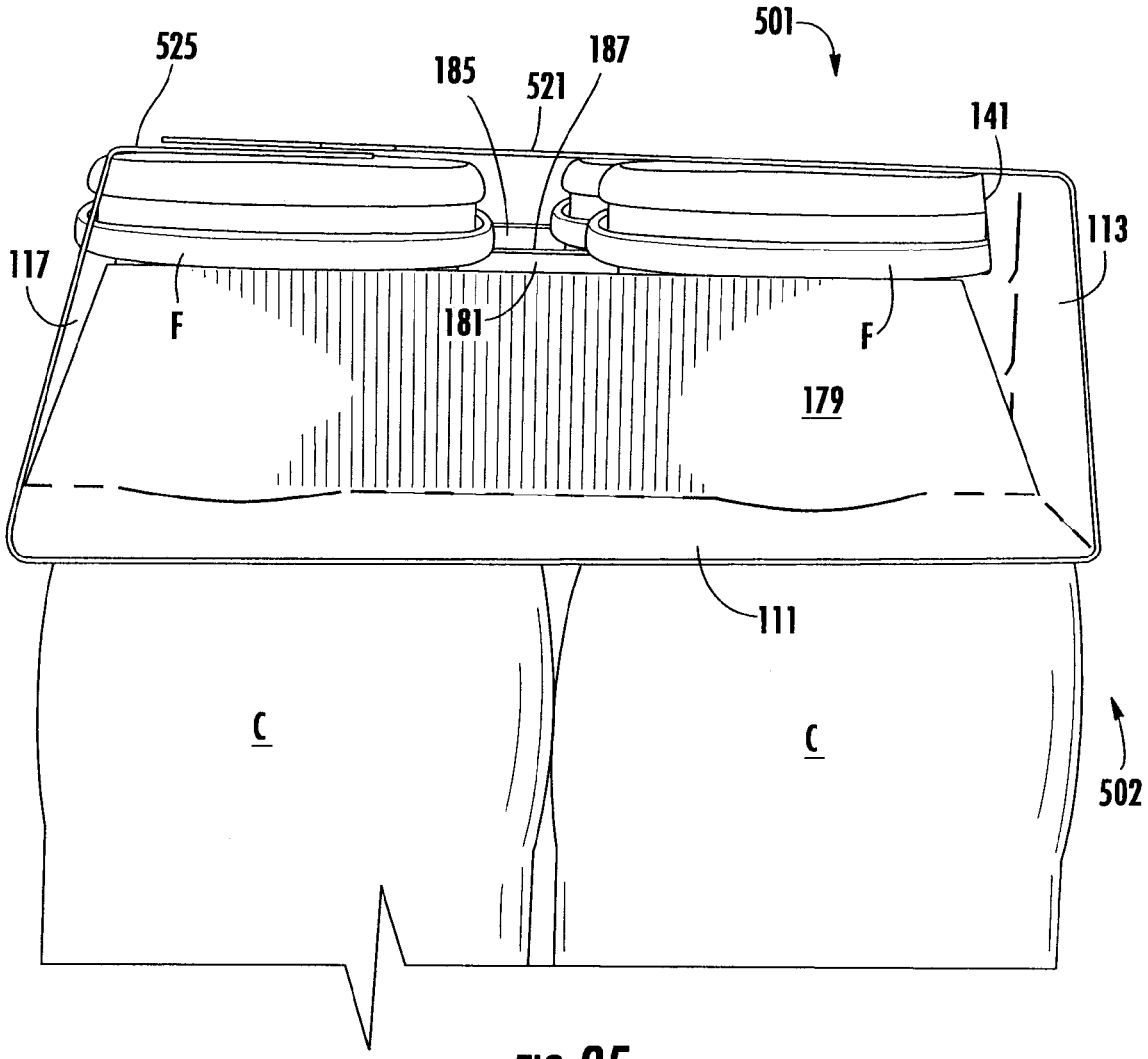
FIGS. 25 and 26 are end views of the package according to the sixth embodiment of the disclosure.
Figure 26:
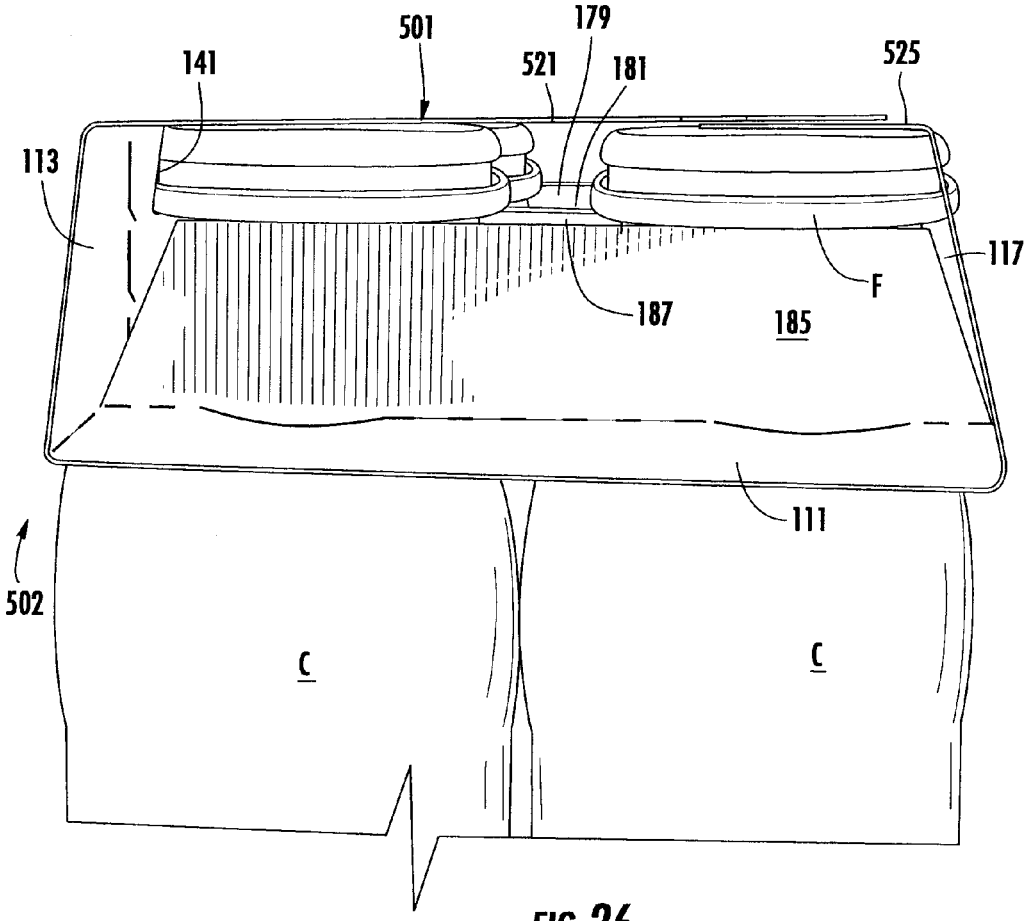

FIG. 22 is a plan view of a blank 508 used to form a carrier 501 (FIGS. 23-26) and a package 502, which includes the carrier 501 and a plurality of containers C retained in the carrier 501 (FIGS. 25 and 26), according to a sixth embodiment of the disclosure. The blank 508 is similar to the blank 308 illustrated in FIG. 16 and discussed above, and like or similar reference numerals may indicate like or similar elements in the figures. The blank 508 includes a bottom panel 111, first side panel 113, and second side panel 117 that are similar to the blank 308 of the fourth embodiment. The blank 508 has a first top panel 521 foldably connected to the first side panel 113 at spaced-apart lateral fold lines 522 that extend from openings 141 in the first side panel and a second top panel 525 foldably connected to the second side panel 117 at spaced-apart lateral fold lines 526 that extend from openings 141 in the second side panel.

Figure 23:
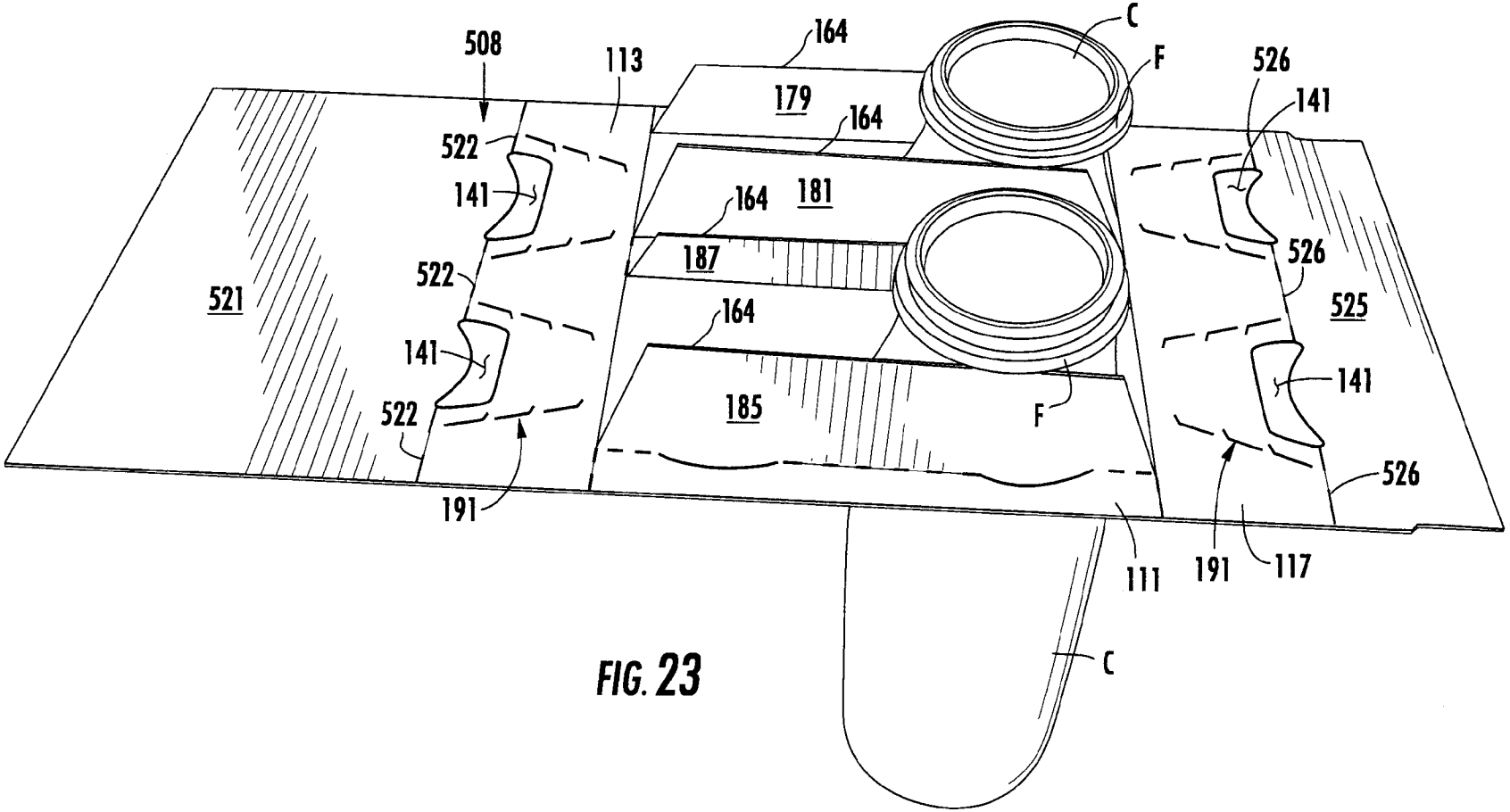
FIGS. 23 and 24 are perspective views showing the erection of the package according to the sixth embodiment of the disclosure.
Figure 24:
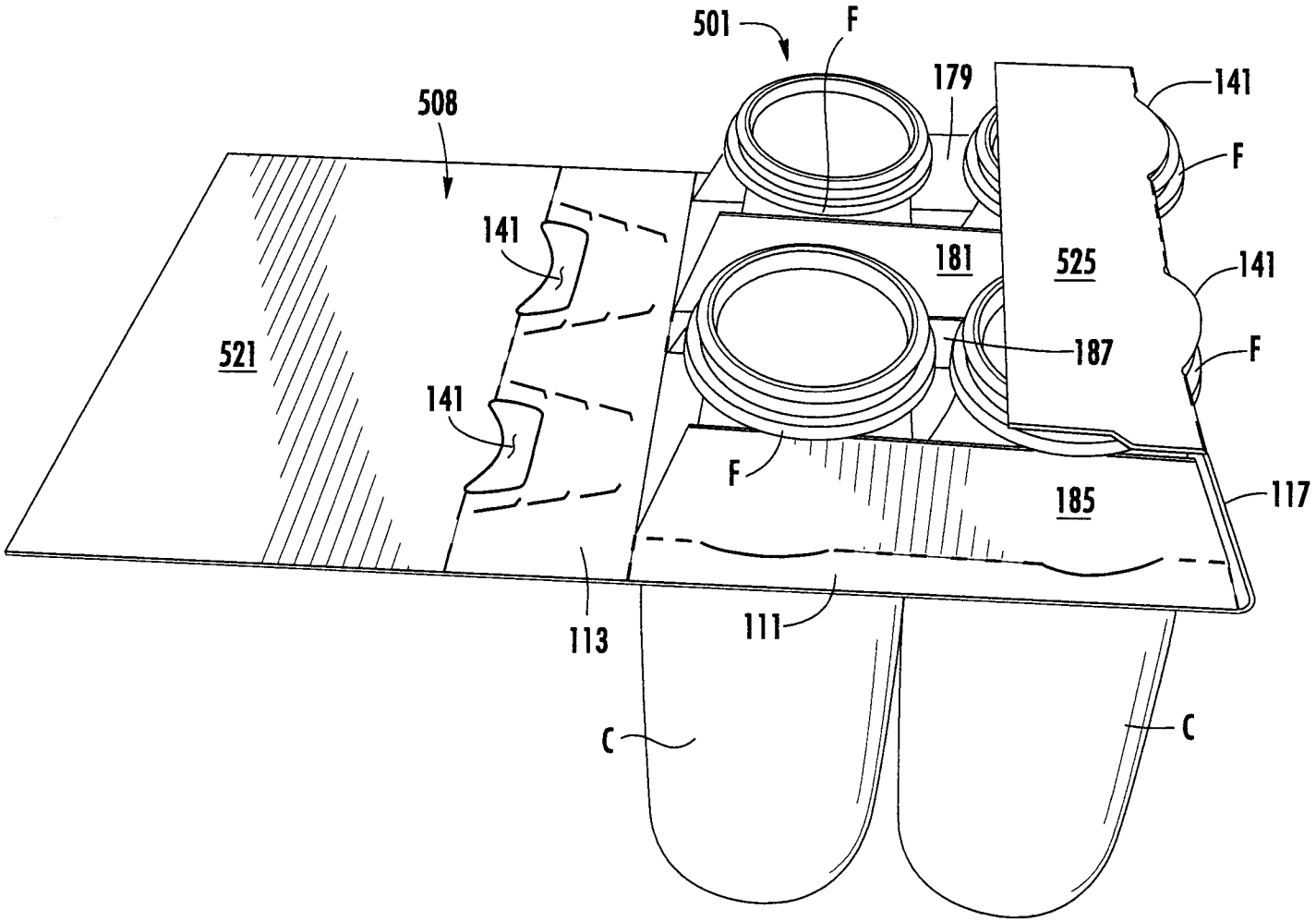

In the embodiment of FIGS. 22-26, the package 502 is formed in a similar manner as the previous embodiments. The containers C (only two of which are shown in FIG. 23) are inserted through the container-receiving openings 175, 177 so that the containers engage respective free edges 164 of the brace flaps 179, 181, 185, 187. The second side panel 117 is upwardly folded relative to the bottom panel 111 so that the flanges F of the containers C in the second column 198, which is adjacent the second side panel 117, are received in the openings 141 of the second side panel. The second top panel 525 is folded relative to the second side panel 117 to the position shown in FIG. 31 so that the second top panel overlaps and is in face-to-face contact with the top of the two containers C in the second column 198. The first side panel 113 is upwardly folded relative to the bottom panel 111 so that the flanges F of the two containers C in the first column 196 (FIGS. 23-36), which is adjacent the first side panel 113, are received in a respective opening 141 in the first side panel. The first top panel 521 is folded relative to the first side panel 113 to the position shown in FIGS. 25 and 26 so that the first top panel overlays the tops of the two containers C in the first column 196 and overlays and is in at least partially face-to-face contact with the second top panel 525. The first top panel 521 can be secured to the second top panel 525 by adhesive such as glue. The carrier 501 can be formed by other panel or flap positioning steps or other methods that are different than the steps or methods described herein.

Figure 27:
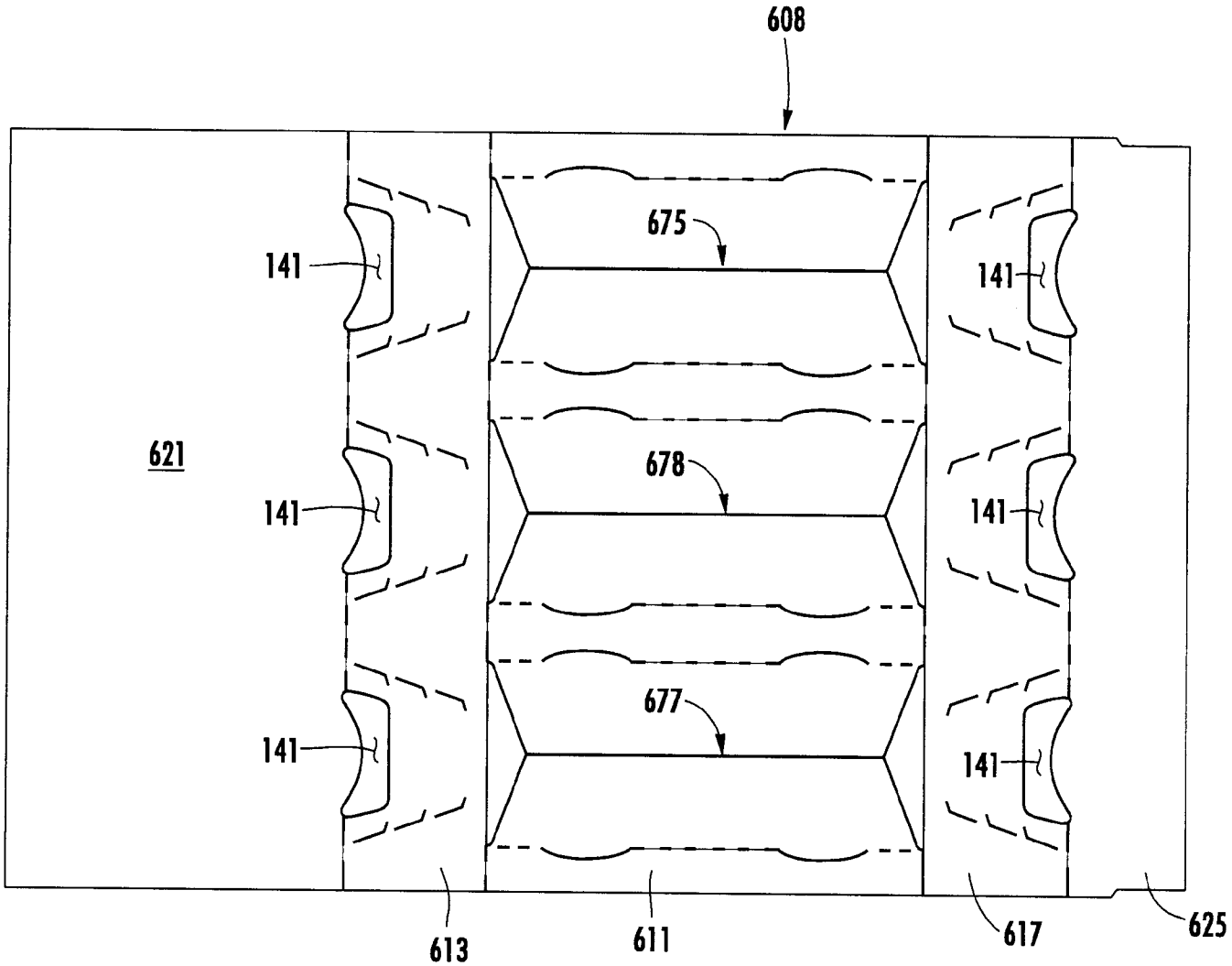
FIG. 27 is an exterior plan view of a blank for forming a package according to a seventh embodiment of the disclosure.

FIG. 27 is a plan view of a blank 608 used to form a carrier (not shown) according to a seventh embodiment. The blank 608 has similar features as the blank 508 of the previous embodiment and like or similar references numbers are used to indicate like or similar features. The blank 608 is sized to hold three columns of two containers C. Accordingly, the bottom panel 611 has three container-receiving patterns 675, 677, 678, the first side panel 613 has three openings 141, and the second side panel 617 has three openings 141. Each container-receiving pattern 675, 677, 678 receives one container C in the first column and one container C in the second column. The first and second top panels 621, 625 are respectively sized to overlap the tops of the containers C housed in the carrier formed from the blank 608. The blank 608 could be otherwise sized, shaped, and/or arranged without departing from the disclosure.

Figure 28:
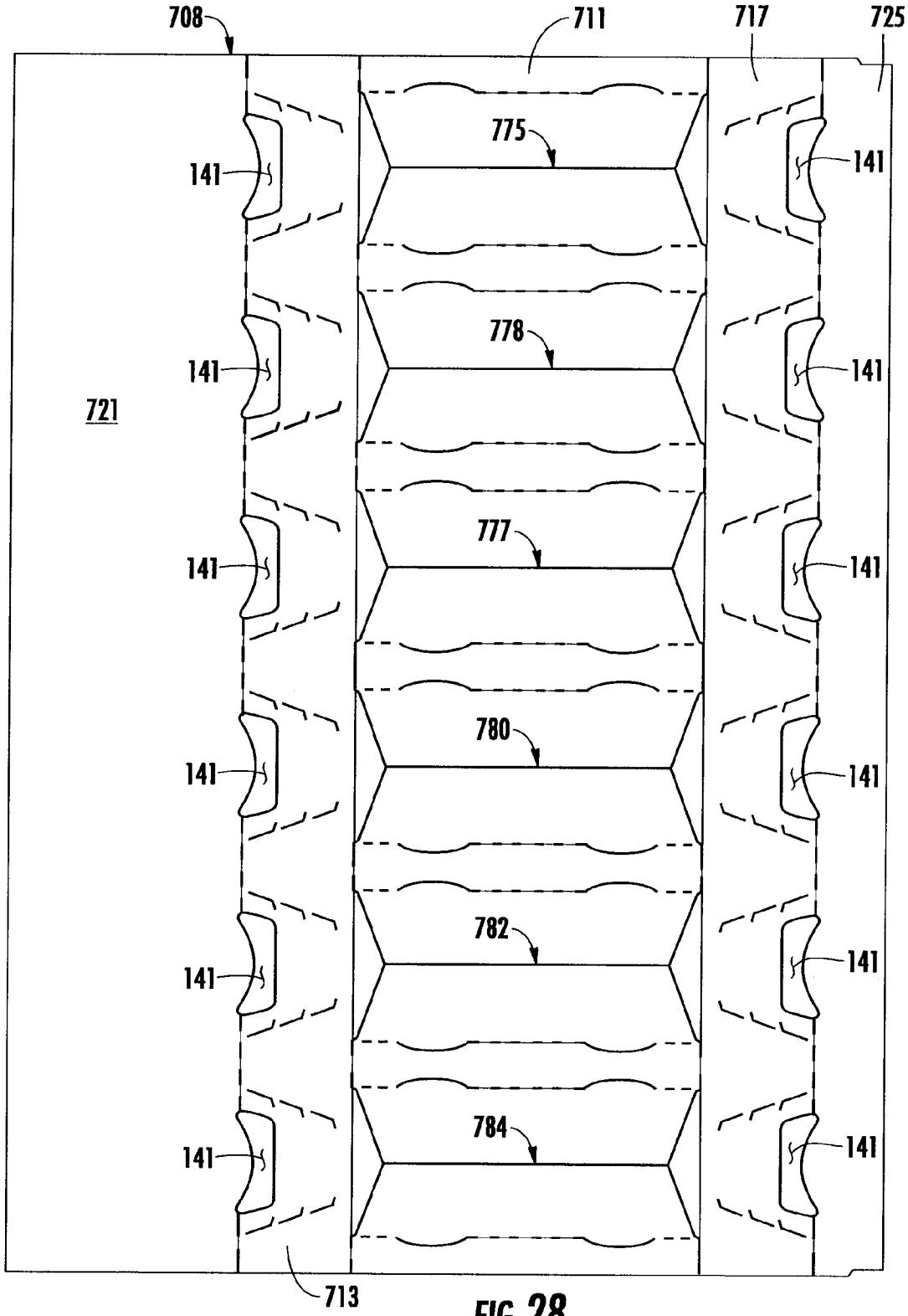
FIG. 28 is an exterior plan view of a blank for forming a package according to an eighth embodiment of the disclosure.

FIG. 28 is a plan view of a blank 708 used to form a carrier (not shown) according to an eighth embodiment. The blank 708 has similar features as the blanks 508, 608 of the previous embodiments and like or similar references numbers are used to indicate like or similar features. The blank 708 is sized to hold six rows of two containers C. Accordingly, the bottom panel 711 has six container-receiving patterns 775, 777, 778, 780, 782, 784, the first side panel 713 has six openings 141, and the second side panel 717 has six openings 141. The first and second top panels 721, 725 are respectively sized to overlap the tops of the containers C housed in the carrier formed from the blank 708. The blank 708 could be otherwise sized, shaped, and/or arranged without departing from the disclosure.

Figure 29A:
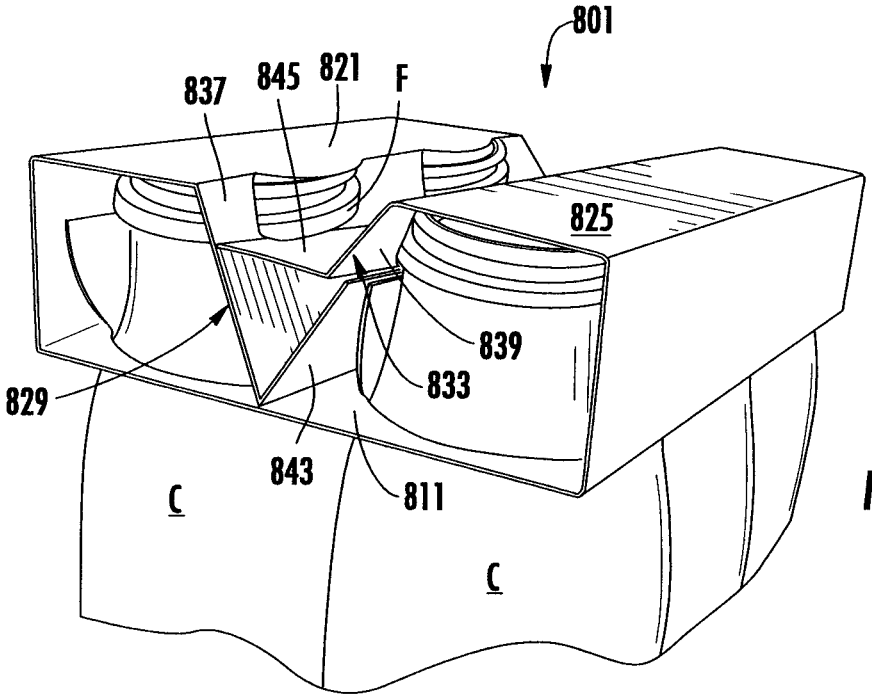
FIG. 29A is a perspective view of a package according to a ninth embodiment of the disclosure.
Figure 29B:
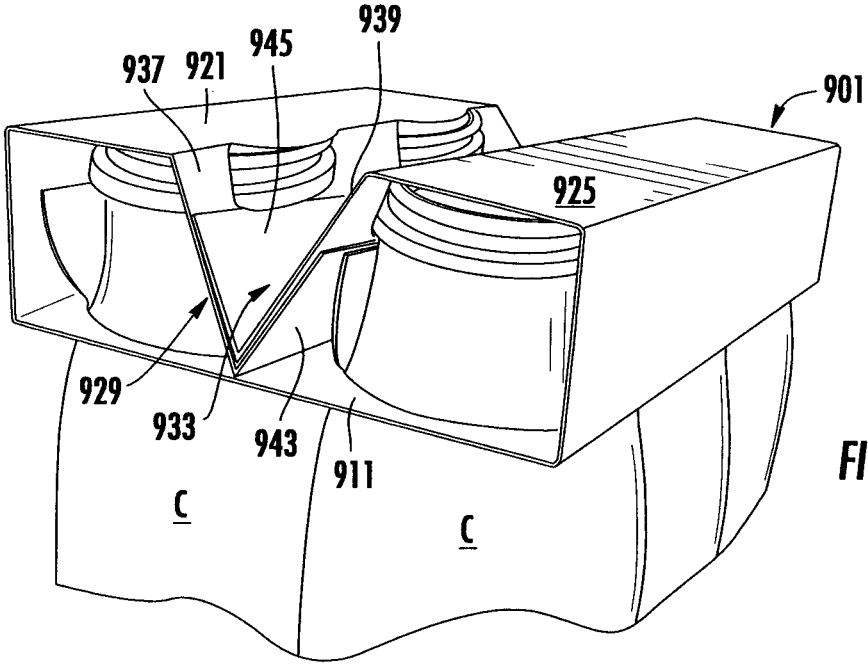
FIG. 29B is a perspective view of a package according to a tenth embodiment of the disclosure.

FIGS. 29A and 29B show a ninth and tenth embodiment, respectively, of the present disclosure. The carrier 801 shown in FIG. 29A has retention flaps 829, 833 foldably connected to respective top panels 821, 825. The retention flap 829 has a first portion 837 and a second portion 843 that are substantially V-shaped in the carrier 801. The retention flap 833 has a first portion 839 that extends obliquely from the top panel 825 and a second portion 845 that extends from the first portion and is generally parallel to the bottom panel 811.

The carrier 901 shown in FIG. 29B has retention flaps 929, 933 foldably connected to respective top panels 921, 925. The retention flap 929 has a first portion 937 and a second portion 943 that are substantially V-shaped in the carrier 901. The retention flap 933 has a first portion 939 and a second portion 945 that are substantially V-shaped with the first portion 939 being in face-to-face contact with the second portion 943 and the second portion 945 being in face-to-face contact with the first portion 937 of the first retention flap 929.

The blanks shown in the embodiments of FIGS. 11, 14, and 16 have a number of locating features 120 that are small curved, indentations at the respective lateral edges of the blanks 108, 208, 308. The blank and package can be configured to include product pitched features to allow various formats to be run on a product pitched machine. Packing equipment would include carton or blank engagement features pitched on the product diameter. This allows any format to run without typical pitched machinery speed limitations. In one example, blank length could be longer than product diameter so that consecutive blanks will overlap within the machine. The packaging machine would include carton engagement lugs that mate with the locating features 120 at the edge of the blanks 108, 208, 308. For example, the engagement lugs could be round pins that match the curved edges of the locating features, but the engagement lugs and locating features could be other shapes.

In the above-discussed embodiments, the term "container-receiving" pattern or aperture should be broadly construed, for example, to mean that at least an upper portion of a container may pass through an aperture designated as "container-receiving" when assembling a package.

The exemplary package embodiments discussed above accommodate various quantities of containers C (e.g., six containers C arranged in two columns and three rows), but the present disclosure is not limited to these numbers or arrangements. As one example, additional rows of containers may be added by increasing the width of the blanks (e.g., in the lateral direction L2 in FIG. 1, and as shown in exemplary embodiments of FIGS. 27 and 28) and forming additional features for accommodating the additional containers.

In the above embodiments, the carriers are shown as accommodating containers C each having a protruding flange F and a generally round upper rim or cap. Other types of containers, however, can be accommodated within a carrier according to the principles of the present disclosure.

In general, the blanks may be constructed from paperboard having a caliper so that it is heavier and more rigid than ordinary paper. The blanks can also be constructed of other materials, such as cardboard, or any other material having properties suitable for enabling the package to function at least generally as described above.

The blanks can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

The above embodiments may be described as having one or panels adhered together by glue. The term "glue" is intended to encompass all manner of adhesives commonly used to secure paperboard carton panels in place.

The term "line" as used herein includes not only straight lines, but also other types of lines such as curved, curvilinear or angularly displaced lines.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The foregoing description of the disclosure illustrates and describes various embodiments of the present disclosure. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments, but other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure without departing from the scope of the disclosure.

What is claimed is:

1. A carrier at least partially holding a plurality of containers, each container of the plurality of containers comprising a flange, the carrier comprising:

a plurality of panels extending at least partially around an interior of the carrier, the panels comprising a bottom panel, a first side panel foldably connected to the bottom panel, a second side panel foldably connected to the bottom panel, a first top panel foldably connected to the first side panel, and a second top panel foldably connected to the second side panel;

at least one container-receiving feature extending in at least the bottom panel, the at least one container-receiving feature at least partially receiving at least one container of the plurality of containers, wherein each container of the plurality of containers is positioned in one of at least a first column extending generally adjacent the first side panel and a second column extending generally adjacent the second side panel; and a first retention flap foldably connected to the first top panel and a second retention flap foldably connected to the second top panel, at least the first retention flap engages at least a portion of the flange of at least one container of the plurality of containers, wherein the first retention flap comprises a first proximal portion that at least partially receives the flange of at least one container in the first column and a first distal portion that at least partially engages the flange of at least one container in the second column, and the second retention flap comprises a second proximal portion that at least partially receives the flange of the at least one container in the second column and a second distal portion that at least partially engages the at least one container in the first column proximate the flange, the second distal portion of the second retention flap being at least partially in face-to-face contact with the first distal portion of the first retention flap.

2. The carrier of claim 1, wherein the first proximal portion and the second proximal portion are foldably connected to the respective first and second top panels, and the first distal portion and the second distal portion are foldably connected to the respective first and second proximal portions.

3. The carrier of claim 2, wherein each of the first proximal portion and the second proximal portion of the respective first and second retention flaps defines at least one opening that at least partially receives the at least one container in the respective first column or second column.

4. The carrier of claim 3, wherein each of the first distal portion and the second distal portion of the respective first and second retention flaps comprises at least one tab extending adjacent the at least one opening in the respective first and second proximal portions of the respective first and second retention flaps.

5. The carrier of claim 3, wherein each of the first side panel and the second side panel defines at least one side opening that receives the at least one container in the respective first column or second column.

6. The carrier of claim 2, further comprising at least one first opening feature extending in at least the first top panel and at least one second opening feature extending in at least the second top panel, at least a portion of each of the first opening feature and the second opening feature extending adjacent the at least one opening in the respective first and second proximal portions of the respective first and second retention flaps.

7. The carrier of claim 1, wherein the at least one container-receiving feature comprises at least one first container-receiving feature and at least one second container-receiving feature, the at least one first container-receiving feature at least partially receiving at least one container in the first column and the at least one second container-receiving feature at least partially receiving at least one container in the second column.

8. The carrier of claim 7, wherein:

the first side panel is foldably connected to the bottom panel along a first transverse fold line, and the second side panel is foldably connected to the bottom panel along a second transverse fold line;

the at least one first container-receiving feature comprising a first outer brace flap foldably connected to the first side panel along the first transverse fold line and a first inner brace flap foldably connected to the bottom panel along a third transverse fold line; and the at least one second container-receiving feature comprising a second outer brace flap foldably connected to the second side panel along the second transverse fold line and a second inner brace flap foldably connected to the bottom panel along a fourth transverse fold line.

9. The carrier of claim 8, wherein:

each of the first outer brace flap and the second outer brace flap comprises a first upper edge at least partially engaging the flange of at least one container of the plurality of containers;

each of the first inner brace flap and the second inner brace flap comprises a second upper edge at least partially engaging at least one of the first retention flap and the second retention flap; and each of the first upper edges of the first outer brace flap and the second outer brace flap is spaced apart from the respective first and second transverse fold lines a first distance, and each of the second upper edges of the first inner brace flap and the second inner brace flap is spaced apart from the respective third and fourth transverse fold lines a second distance, the first distance being greater than the second distance.

10. The carrier of claim 1, wherein the at least one container-receiving feature comprises a first brace flap and a second brace flap, the first brace flap and the second brace flap extending in a generally longitudinal direction.

11. The carrier of claim 10, wherein:

the at least one container-receiving feature at least partially receives at least two containers of the plurality of containers;

the at least two containers comprise at least one container in the first column and at least one container in the second column; and each of the first brace flap and the second brace flap of the at least one container-receiving feature at least partially engage the flanges of the at least two containers at least partially received in the at least one container-receiving feature.

12. The carrier of claim 11, wherein:

each of the first brace flap and the second brace flap comprises an upper edge defining a recess, each recess at least partially receiving at least one of the first retention flap and the second retention flap; and each of the first brace flap and the second brace flap is foldably connected to the bottom panel along a respective longitudinal fold line.

13. The carrier of claim 10, wherein each of the first brace flap and the second brace flap of the at least one container-receiving feature defines at least one brace opening that at least partially receives a shoulder portion of at least one container of the plurality of containers.

14. The carrier of claim 1, further comprising at least a first opening feature extending in at least the first side panel and a second opening feature extending in at least the second side panel, and each of the first opening feature and the second opening feature comprises two spaced-apart longitudinal tear lines extending in at least the respective first and second side panels.

15. The carrier of claim 14, wherein each of the first opening feature and the second opening feature extends at least partially across the respective first and second top panel.

16. The carrier of claim 1, wherein at least one of the first retention flap and the second retention flap is generally V-shaped.

17. The carrier of claim 1, wherein at least a portion of the first retention flap overlaps at least a portion of the second retention flap.

18. The carrier of claim 1, wherein each of the first retention flap and the second retention flap is spaced apart from the bottom panel.

19. The carrier of claim 16, wherein the first distal portion of the first retention flap is foldably connected to the first proximal portion of the first retention flap along a first fold line, and the second distal portion of the second retention flap is foldably connected to the second proximal portion of the second retention flap along a second fold line, the first proximal portion and the second proximal portion extending generally downwardly, and the first distal portion and the second distal portion extending generally upwardly from the respective first fold line and second fold line to form the generally V-shaped first retention panel and second retention panel.

20. A carrier at least partially holding a plurality of containers, each container of the plurality of containers comprising a flange, the carrier comprising:

a plurality of panels extending at least partially around an interior of the carrier, the panels comprising a bottom panel, a first side panel foldably connected to the bottom panel, a second side panel foldably connected to the bottom panel, a first top panel foldably connected to the first side panel, and a second top panel foldably connected to the second side panel;

at least one container-receiving feature extending in at least the bottom panel, the at least one container-receiving feature at least partially receiving at least two containers of the plurality of containers, wherein the at least one container-receiving feature comprises at least a first brace flap and a second brace flap, each of the first brace flap and the second brace flap extending in a generally longitudinal direction and comprising a respective first upper edge and second upper edge that is spaced apart from the bottom panel, and wherein the first upper edge of the first brace flap at least partially engages both of the respective flanges of the at least two containers at least partially received in the at least one container-receiving feature, and the second upper edge of the second brace flap at least partially engages both of the respective flanges of the at least two containers at least partially received in the at least one container-receiving feature.

21. The carrier of claim 20, wherein the at least two containers at least partially received in the at least one container-receiving feature comprise at least one container in a first column extending generally adjacent the first side panel and at least one container in a second column extending generally adjacent the second side panel.

22. The carrier of claim 21, wherein:

each of the first brace flap and the second brace flap is foldably connected to the bottom panel along a respective first longitudinal fold line and second longitudinal fold line; and at least a portion of each of the first brace flap and the second brace flap is separated from the bottom panel along at least one curved cut line.

23. The carrier of claim 22, wherein each of the first brace flap and the second brace flap is further separated from the bottom panel along an oblique cut line at each end of the respective first brace flap and second brace flap.

24. The carrier of claim 21, wherein each of the first side panel and the second side panel defines at least one side opening that at least partially receives a container of the plurality of containers in the respective first column or second column.

25. The carrier of claim 21, wherein the at least one container-receiving feature comprises at least three container-receiving features.

26. The carrier of claim 22, wherein each of the first brace flap and the second brace flap of the at least one container-receiving feature defines at least one brace flap opening that at least partially receives a shoulder portion of a container of the plurality of containers.

27. The carrier of claim 20, further comprising at least a first opening feature extending in at least the first side panel and a second opening feature extending in at least the second side panel, and each of the first opening feature and the second opening feature comprises two spaced-apart tear lines extending in at least the respective first and second side panels.

28. The carrier of claim 20, wherein a retention flap is foldably connected to the second top panel and engages at least a portion of the flange of a container of the plurality of containers.

29. The carrier of claim 28, wherein each of the first upper edge of the first brace flap and the second upper edge of the second brace flap comprises a recess, at least a portion of the retention flap being received in each recess.

30. The carrier of claim 28, wherein:

the at least two containers at least partially received in the at least one container-receiving feature comprise at least one container in a first column extending generally adjacent the first side panel and at least one container in a second column extending generally adjacent the second side panel;

the retention flap comprises a proximal portion foldably connected to the second top panel and a distal portion foldably connected to the proximal portion;

the proximal portion defines at least one opening that at least partially receives the at least one container in the second column; and the distal portion at least partially engages the flange of the at least one container in the first column.

31. The carrier of claim 30, wherein the distal portion of the retention flap comprises at least one tab with a curved edge, the at least one tab extending adjacent the at least one opening in the proximal portion of the retention flap.

32. The carrier of claim 20, wherein the first top panel at least partially overlaps the second top panel.

33. The carrier of claim 20, wherein each of the first brace flap and the second brace flap extends generally perpendicular to at least one of the first side panel and the second side panel.

34. The carrier of claim 20, wherein the at least one container-receiving feature comprises an opening in the bottom panel, the first brace flap and the second brace flap being foldably connected to the bottom panel adjacent the opening, and the at least two containers at least partially extending through the opening.

35. The carrier of claim 20, wherein each of the first brace flap and the second brace flap is foldably connected to the bottom panel along a respective first longitudinal fold line and second longitudinal fold line, and each of the first upper edge and the second upper edge is spaced apart from the respective first longitudinal fold line and second longitudinal fold line, the first upper edge and the second upper edge being disposed generally above the respective first longitudinal fold line and second longitudinal fold line.

36. The carrier of claim 20, wherein each of the first upper edge and the second upper edge contacts a respective underside of each of the respective flanges of the at least two containers at least partially received in the at least one container-receiving feature.

37. A blank for forming a carrier for at least partially holding a plurality of containers, each container of the plurality of containers comprising a flange, the blank comprising:

a plurality of panels comprising a bottom panel, a first side panel foldably connected to the bottom panel, a second side panel foldably connected to the bottom panel, a first top panel foldably connected to the first side panel, and a second top panel foldably connected to the second side panel;

at least one container-receiving feature extending in at least the bottom panel for at least partially receiving at least one container of the plurality of containers when the carrier is formed from the blank, wherein each container of the plurality of containers is for being positioned in one of at least a first column extending generally adjacent the first side panel and a second column extending generally adjacent the second side panel when the carrier is formed from the blank; and a first retention flap foldably connected to the first top panel and a second retention flap foldably connected to the second top panel, wherein the first retention flap comprises a first proximal portion for at least partially receiving the flange of at least one container in the first column and a first distal portion for at least partially engaging the flange of at least one container in the second column when the carrier is formed from the blank, and the second retention flap comprises a second proximal portion for at least partially receiving the flange of the at least one container in the second column and a second distal portion for at least partially engaging the at least one container in the first column proximate the flange when the carrier is formed from the blank, the second distal portion of the second retention flap for being positioned at least partially in face-to-face contact with the first distal portion of the first retention flap when the carrier is formed from the blank.

38. The blank of claim 37, wherein the first proximal portion and the second proximal portion are foldably connected to the respective first and second top panels, and the first distal portion and the second distal portion are foldably connected to the respective first and second proximal portions.

39. The blank of claim 38, wherein each of the first proximal portion and the second proximal portion of the respective first and second retention flaps defines at least one opening for at least partially receiving the at least one container in the respective first column or second column when the carrier is formed from the blank.

40. The blank of claim 39, wherein each of the first distal portion and the second distal portion of the respective first and second retention flaps comprises at least one tab extending adjacent the at least one opening in the respective first and second proximal portions of the respective first and second retention flaps.

41. The blank of claim 39, wherein each of the first side panel and the second side panel defines at least one side opening for receiving the at least one container in the respective first column or second column when the carrier is formed from the blank.

42. The blank of claim 37, wherein the at least one container-receiving feature comprises at least one first container-receiving feature and at least one second container-receiving feature, the at least one first container-receiving feature being for at least partially receiving at least one container in the first column and the at least one second container-receiving feature being for at least partially receiving at least one container in the second column when the carrier is formed from the blank.

43. The blank of claim 42, wherein:

the first side panel is foldably connected to the bottom panel along a first transverse fold line, and the second side panel is foldably connected to the bottom panel along a second transverse fold line;

the at least one first container-receiving feature comprising a first outer brace flap foldably connected to the first side panel along the first transverse fold line and a first inner brace flap foldably connected to the bottom panel along a third transverse fold line; and the at least one second container-receiving feature comprising a second outer brace flap foldable connected to the second side panel along the second transverse fold line and a second inner brace flap foldably connected to the bottom panel along a fourth transverse fold line.

44. The blank of claim 43, wherein:

the first outer brace flap is separable from the first inner brace flap along a first transverse cut line, and the second outer brace flap is separable from the second inner brace flap along a second transverse cut line;

each the first transverse cut line and the second transverse cut line is spaced apart from the respective first transverse fold line and the second transverse fold line a first distance, and each of the first transverse cut line and the second transverse cut line is spaced apart from the respective third transverse fold line and the fourth transverse fold line a second distance; and the first distance is greater than the second distance.

45. The blank of claim 37, wherein the at least one container-receiving feature comprises a first brace flap and a second brace flap, the first brace flap and the second brace flap extending in a generally longitudinal direction.

46. The blank of claim 45, wherein the at least one container-receiving feature is for at least partially receiving at least one container in the first column and at least one container in the second column when the carrier is formed from the blank.

47. The blank of claim 46, wherein each of the first brace flap and the second brace flap is foldably connected to the bottom panel along a respective longitudinal fold line.

48. The blank of claim 37, further comprising at least a first opening feature extending in at least the first side panel and a second opening feature extending in at least the second side panel, and each of the first opening feature and the second opening feature comprises two spaced-apart longitudinal tear lines extending in at least the respective first and second side panels.

49. A blank for forming a carrier for at least partially holding a plurality of containers, each container of the plurality of containers comprising a flange, the blank comprising:

a plurality of panels comprising a bottom panel, a first side panel foldably connected to the bottom panel, and a second side panel foldably connected to the bottom panel, a first top panel foldably connected to the first side panel, and a second top panel foldably connected to the second side panel;

at least one container-receiving feature extending in at least the bottom panel, the at least one container-receiving feature being for at least partially receiving at least two containers of the plurality of containers when the carrier is formed from the blank, wherein the at least one container-receiving feature comprises at least a first brace flap and a second brace flap, each of the first brace flap and the second brace flap extending in a generally longitudinal direction and comprising a respective first upper edge and second upper edge that are for being spaced apart from the bottom panel when the carrier is formed from the blank, and wherein the first upper edge of the first brace flap is for at least partially engaging both of the respective flanges of the at least two containers for being at least partially received in the at least one container-receiving feature when the carrier is formed from the blank, and the second upper edge of the second brace flap is for at least partially engaging both of the respective flanges of the at least two containers for being at least partially received in the at least one container-receiving feature when the carrier is formed from the blank.

50. The blank of claim 49, wherein the at least one container-receiving feature is for at least partially receiving at least one container in a first column extending generally adjacent the first side panel and at least one container in a second column extending generally adjacent the second side panel when the carrier is formed from the blank.

51. The blank of claim 50, wherein:

each of the first brace flap and the second brace flap is foldably connected to the bottom panel along a respective first longitudinal fold line and second longitudinal fold line; and at least a portion of each of the first brace flap and the second brace flap is separated from the bottom panel along at least one curved cut line.

52. The blank of claim 51, wherein each of the first brace flap and the second brace flap is further separated from the bottom panel along an oblique cut line at each end of the respective first brace flap and second brace flap.

53. The blank of claim 50, wherein each of the first side panel and the second side panel defines at least one side opening for at least partially receiving a container of the plurality of containers in the respective first column or second column when the carrier is formed from the blank.

54. The blank of claim 50, wherein the at least one container-receiving feature comprises at least three container-receiving features.

55. The blank of claim 49, further comprises at least a first opening feature extending in at least the first side panel and a second opening feature extending in at least the second side panel, and each of the first opening feature and the second opening feature comprises two spaced-apart tear lines extending in at least the respective first and second side panels.

56. The blank of claim 49, wherein a retention flap is foldably connected to the second top panel for engaging at least a portion of the flange of a container of the plurality of containers when the carrier is formed from the blank.

57. The blank of claim 56, wherein each of the first upper edge of the first brace flap and the second upper edge of the second brace flap comprises a recess, at least a portion of the retention flap for being received in each recess when the carrier is formed from the blank.

58. The blank of claim 56, wherein:

the retention flap comprises a proximal portion foldably connected to the second top panel and a distal portion foldably connected to the proximal portion;

the proximal portion defines at least one opening for at least partially receiving the flange of a container of the plurality of containers when the carrier is formed from the blank; and the distal portion is for at least partially engaging the flange of a container of the plurality of containers when the carrier is formed from the blank.

59. A method of forming a carrier at least partially holding a plurality of containers, each container of the plurality of containers comprising a flange, the method comprising:

obtaining a blank comprising a plurality of panels comprising a bottom panel, a first side panel foldably connected to the bottom panel, a second side panel foldably connected to the bottom panel, a first top panel foldably connected to the first side panel, a second top panel foldably connected to the second side panel, a first retention flap foldably connected to the first top panel, and a second retention flap foldably connected to the second top panel, wherein at least one first container-receiving feature and at least one second container-receiving feature extend in at least the bottom panel;

inserting at least a portion of at least one container of the plurality of containers in a first column through one of the at least one first container-receiving feature and the second container-receiving feature, and inserting at least one container in a second column into one of the at least one first container-receiving feature and the at least one second container-receiving feature, the at least one container in the first column extending generally adjacent the first side panel, and the at least one container in the second column extending generally adjacent the second side panel;

forming an interior of the carrier at least partially defined by the plurality of panels, the flanges of each container of the plurality of containers being at least partially enclosed in the interior of the carrier;

positioning the second retention flap to engage at least a portion of the flange of at least one container of the plurality of containers, the positioning at least the second retention flap comprising positioning a second proximal portion of the second retention flap to at least partially receive the at least one container in the second column and a second distal portion of the second retention flap to at least partially engage the at least one container in the first column proximate the flange; and positioning the first retention flap to engage at least a portion of the flange of at least one container of the plurality of containers, the positioning at least the first retention flap comprising positioning a first proximal portion of the first retention flap to at least partially receive the at least one container in the first column and a first distal portion of the first retention flap to at least partially engage the flange of the at least one container in the second column, wherein the positioning the first distal portion of the first retention flap comprises disposing the first distal portion at least partially in face-to-face contact with the second distal portion.

60. The method of claim 59, wherein:

the at least one first container-receiving feature comprises a first outer brace flap foldably connected to the first side panel along a first transverse fold line and a first inner brace flap foldably connected to the bottom panel along a second transverse fold line; and the at least one second container-receiving feature comprises a second outer brace flap foldably connected to the second side panel along a third transverse fold line and a second inner brace flap foldably connected to the bottom panel along a fourth transverse fold line.

61. The method of claim 60, wherein the inserting at least a portion of the at least one container in the first column comprises at least partially engaging each of the first outer brace flap and the first inner brace flap with the flange of the at least one container in the first column, and the inserting at least a portion of the at least one container in the second column comprises at least partially engaging each of the second outer brace flap and the second inner brace flap with the flange of the at least one container in the second column.

62. The method of claim 61, wherein:

the first proximal portion is foldably connected to the first top panel and the first distal portion is foldably connected to the first proximal portion;

the second proximal portion is foldably connected to the second top panel and the second distal portion is foldably connected to the second proximal portion.

63. The method of claim 59, wherein:

the at least one first container-receiving feature comprises a first brace flap foldably connected to the bottom panel along a first longitudinal fold line and a second brace flap foldably connected to the bottom panel along a second longitudinal fold line;

the inserting at least a portion of the at least one container in the first column comprises at least partially inserting a first container into the at least one first container-receiving feature in the first column, and the inserting at least a portion of the at least one container in the second column comprises at least partially inserting a second container into the at least one first container-receiving feature in the second column;

each of the first brace flap and the second brace flap at least partially engages the flanges of the first container and the second container.

64. A method of forming a carrier at least partially holding a plurality of containers, each container of the plurality of containers comprising a flange, the method comprising:

obtaining a blank comprising a plurality of panels comprising a bottom panel, a first side panel foldably connected to the bottom panel, and a second side panel foldably connected to the bottom panel, a first top panel foldably connected to the first side panel, and a second top panel foldably connected to the second side panel, wherein at least one container-receiving feature extends in at least the bottom panel and comprises at least a first brace flap and a second brace flap, each of the first brace flap and the second brace flap extending in a generally longitudinal direction and comprising a respective first upper edge and second upper edge;

inserting at least a portion of a first container of the plurality of containers and at least a portion of a second container of the plurality of containers through the at least one container-receiving feature so that the first upper edge of the first brace flap is spaced apart from the bottom panel and at least partially engages both of the respective flanges of the first container and the second container and the second upper edge of the second brace flap is spaced apart from the bottom panel and at least partially engages both of the respective flanges of the first container and the second container; and forming an interior of the carrier at least partially defined by the plurality of panels, the flanges of each container of the plurality of containers being at least partially enclosed in the interior of the carrier.

65. The method of claim 64, wherein:

each of the first brace flap and the second brace flap is foldably connected to the bottom panel along a respective first longitudinal fold line and second longitudinal fold line; and at least a portion of each of the first brace flap and the second brace flap is separated from the bottom panel along at least one curved cut line.

66. The method of claim 64, wherein:

the blank further comprises a retention flap comprising a proximal portion foldably connected to the second top panel and a distal portion foldably connected to the proximal portion;

the method further comprises positioning the proximal portion to at least partially engage the second container inserted in the at least one container-receiving feature and the distal portion to at least partially engage the first container inserted in the at least one container-receiving feature.

* * * * *